United States Patent [19]

Roberts

[11] 4,325,409

[45] Apr. 20, 1982

[54] PILOT VALVE FOR SUBSEA TEST VALVE SYSTEM FOR DEEP WATER

[75] Inventor: William M. Roberts, Deer Park, Tex.

[73] Assignee: Baker International Corporation, Orange, Calif.

[21] Appl. No.: 93,752

[22] Filed: Nov. 13, 1979

Related U.S. Application Data

[62] Division of Ser. No. 843,154, Oct. 10, 1977, Pat. No. 4,234,043.

[51] Int. Cl.[3] ..... E21B 34/16; F15B 11/16

[52] U.S. Cl. ..... 137/596.14; 137/624.2; 166/72; 166/321

[58] Field of Search ..... 166/319, 321, 72; 137/624.2, 625.48, 596.14, 596.15

[56] References Cited

U.S. PATENT DOCUMENTS

| | | | |
|---|---|---|---|
| 3,399,698 | 9/1968 | Bentley | 137/624.2 |
| 3,872,876 | 3/1975 | Bachman | 137/624.2 |
| 3,970,144 | 7/1976 | Boykin, Jr. | 166/321 |
| 4,078,579 | 3/1978 | Bucko, Sr. | 137/625.48 |

*Primary Examiner*—James A. Leppink
*Attorney, Agent, or Firm*—Bernard Kriegel; Philip Subkow

[57] ABSTRACT

A subsea test valve system for wells completed at the floor of the sea includes a safety valve and disconnect mechanism mounted in a blowout preventer at the bottom of the sea and having hydraulic fluid pressure operated means for opening the safety valve and controlling a latch in the disconnect mechanism. A tubing test string shut off valve is releasably latched in the disconnect mechanism and has a hydraulic fluid operated shut off valve and a valve for venting the test string to the riser pipe which extends from the blowout preventer to the vessel or platform at the surface of the sea. The subsea hydraulic pressure operated devices are supplied with pressure fluid from a subsea accumulator under the control of subsea pilot valves which are operated by small pressure differences, to accomplish rapid operation at great depth from a control console on the vessel or platform.

5 Claims, 34 Drawing Figures

16
800b
800K
4
801a
800g
801h
801d
800e
4
801c
800f
802a
SA
802c
802b
802
802a
800
801
800a 801k
801j
800e
801d
801h
801i
801a
801b
801e
801g
801f 800i
800m
800h
800j
800l
803a
800c
800d
16

16
5
16a
5
600
716
700
702
P
702
721
16b 303
302
317
316
507
503
501
T
502
500
517
516
515
506
518
314
513
504
519
509
514
510
509
508
511
312
512
315

16
~615~
803
600
16a
728a
616
618
715a
~617~
623
614
613
611a
612
621
611b
702
8
8
601
622
613
602
611
610
619
630
620
611c
613
632
634
629
624
625
631
633
628
627
635

PILOT VALVE FOR SUBSEA TEST VALVE SYSTEM FOR DEEP WATER

This application is a division of pending application, Ser. No. 843,154, filed Oct. 10, 1977, now U.S. Pat. No. 4,234,043.

Removable test trees have heretofore been provided for use in performing certain well bore tests in wells completed at the floor of the sea from a drilling vessel or platform at the surface of the water. In the U.S. Pat. No. 3,870,101, granted Mar. 11, 1975 for "REMOVABLE SUBSEA PRODUCTION TEST VALVE ASSEMBLY," a test valve assembly is disclosed which is adapted to be incorporated in a tubing or pipe string lowered from a drilling vessel or platform to dispose the lower test string of tubing in the well bore, and the test valve means is located in the subsea blowout preventer which is closed about it. The test valves are actuated to an open condition by hydraulic fluid pressure supplied from the vessel or platform through control tubings. A releasable latch mecanism is also controlled by fluid pressure supplied from the vessel or platform to release or disconnect the upwardly extending tubing or pipe string, after closure of the test valve, leaving the closed test valve in the blowout preventer, which can be closed above it. Such systems enable the tubing string to be released from the subsea structure and the well to be controlled during inclement weather or for other reasons requiring removal of the tubing between the subsea structure and the vessel or platform.

As subsea completions are made at greater depths, such systems may require excessive time for their operation. To effect an emergency release during a well test, the fluid pressure in the valve control line is bled off at the surface and the valve automatically closes; pressure in the tubing between the test valve assembly and the surface is bled off; and then the control pressure is applied to the disconnect latch to enable removal of the tubing to the surface. These control lines or hoses are on a reel on the vessel or platform, and the time required to bleed off pressure to allow valve closure and to increase pressure to release the latch depends on the length of such hoses. Thus, the deeper the subsea structure the longer the time necessary to change the effective pressure at the valve means and at the latch means. Furthermore, if high pressure well fluid exists in the tubing extending from the subsurface tree to the vessel, additional time must be allowed for the bleeding off of such pressure before the latch can be released.

The present invention relates to subsea test valve apparatus of the type referred to above, and more particularly to improvements enabling or causing rapid operation at substantial depths, for example, say within 20 seconds at a depth of 5000'.

In accomplishing the foregoing, a subsea pressure source or accumulator is pressurized to provide the necessary operating fluid pressures and operation of the system from the surface is effected through subsea pilot valves which respond to a small pressure change. In addition, a tubing shutoff valve is employed and is responsive to the subsea pilot valve means to close off the tubing above the latch means and dump to the riser pipe the high pressure fluid from a short subsurface section of the tubing, so that the latch can be quickly released.

The subsea pilot valves, of the present invention, comprise a quick acting dump valve and a quick acting disconnect valve, the disconnect valve being responsive to a positive pressure signal from the surface, so that hose failure cannot cause an untimely disconnect. The control fluid line for the test tree valve is independent of the pilot lines, enabling normal, independent control of the test tree valve means.

The subsea system also lends itself to the incorporation therein of means enabling the injection of certain inhibitors into the apparatus, say, the injection of glycol through a check valve device into a protected area, so as to prevent formation of hydrates commonly encountered in production of wells.

An object of the invention, therefore, is to provide a subsea test valve system for wells completed at the floor of the sea, in deep water from a vessel or platform, which enables rapid release of the tubing from the subsea structure.

Still another object is to provide subsurface test valve apparatus with fast-acting pilot valve means operable in response to small pressure changes to effect operation of the subsurface test valve means.

In accomplishing the foregoing, the present invention provides control fluid pressure opened subsurface test valve means which close in the absence of control fluid pressure supplied from the surface, a control fluid pressure opened tubing valve means, above the test valve means, which can be closed by operating fluid pressure supplied from a subsurface fluid source which also releases latch means releasably holding the tubing valve means connected to the test valve means, the application of control fluid pressure to the respective open valve means and the application of latch releasing pressure to the tubing valve means and the latch means being controlled by subsurface pilot valve means and associated control valves at the surface, whereby the response time for effecting emergency closure of the test valve means and the tubing valve means is rapid, as compared with systems in which the control and release fluid pressures are varied by a surface source. In addition, the tubing valve means has additional valve means which vent the structure between the test valve means and the tubing valve, after they are closed, and before the latch is released. In this combination, the pilot valve means has a quick dump valve for bleeding off, at the subsurface location, the control fluid pressure which holds the test valve and tubing valve open so that the safety valve will close and the tubing valve can close. Also, the pilot valve means includes a quick disconnect valve which is responsive to the pilot pressure which holds the dump valve closed to prevent inadvertent opening of the disconnect valve and is also responsive to the pressure of disconnect fluid to remain closed, even after bleeding off of the dump valve pilot pressure, until a positive disconnect pilot pressure is applied to the disconnect valve to cause it to open and allow fluid pressure from the subsea source to cause the sequential closure of the tubing valve means, opening of the additional valve means to vent to the exterior the structure between the closed test valve and tubing valve, and finally release the latch means. Because of an equilization in the control system between disconnect pressure and test valve and tubing valve opening control pressure when the valves are open, the latch cannot be released until desired. Further since the disconnect pilot pressure must be positive, that is, in excess of hydrostatic pressure, the latch cannot be released, except mechanically, even in the event of failure of the conduits leading from the subsurface structures to the surface.

This invention possesses many other advantages, and has other purposes which may be made more clearly apparent from a consideration of a form in which it may be embodied. This form is shown in the drawings accompanying and forming part of the present specification. It will now be described in detail, for the purpose of illustrating the general principles of the invention; but it is to be understood that such detailed description is not to be taken in a limiting sense.

Referring to the drawings:

FIGS. 1*a* and 1*b*, together, constitute a diagrammatic illustration of the removable subsea test valve system for deep water in accordance with the invention, landed in the mudline casing hanger and in activated condition, FIG. 1*b* being a downward continuation of FIG. 1*a;*

FIG. 2 is a fragmentary detail view in vertical section, showing the interior of the casing hanger assembly;

FIGS. 3*a* through 3*o*, together, constitute an enlarged longitudinal section of the subsea test valve and tubing valve assemblies latched together in the activated condition of FIGS. 1*a* and 1*b*, FIGS. 3*b* through 3*o* being successive downward continuations of FIG. 3*a;*

Figure 5:
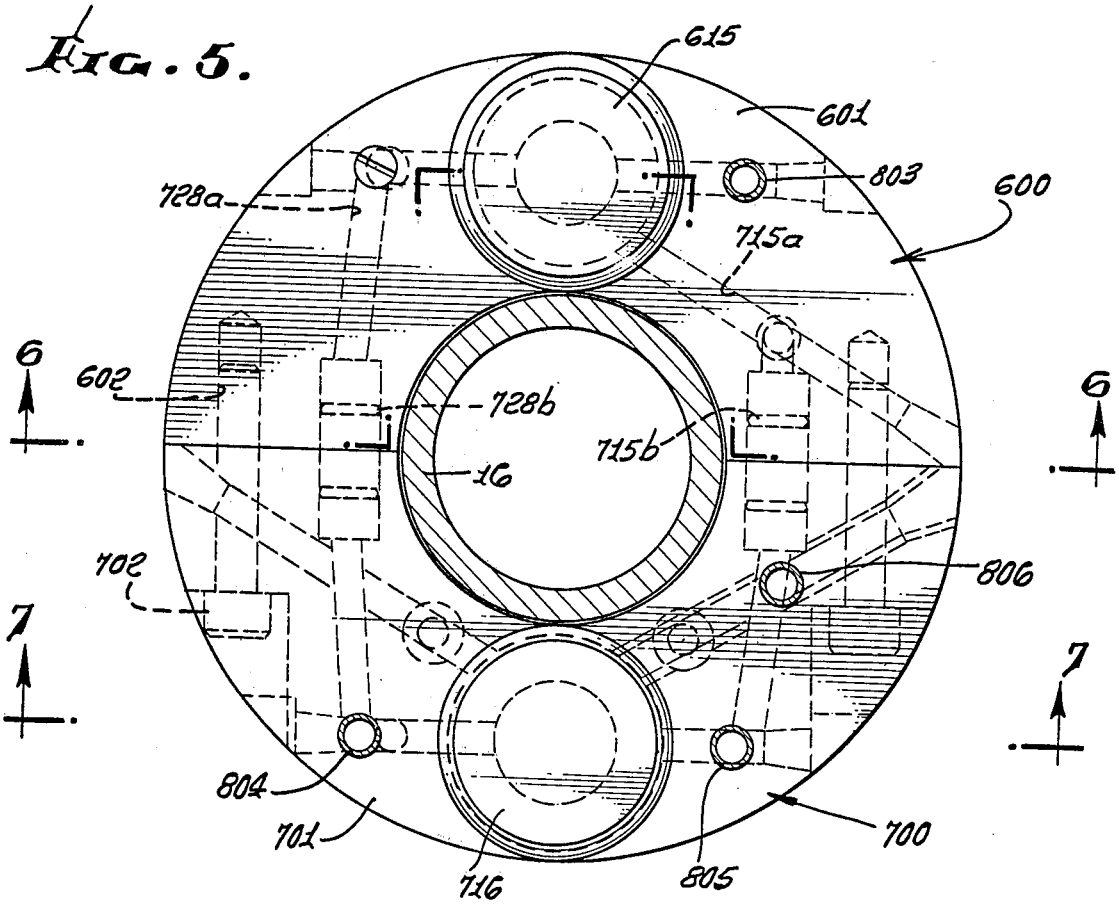
FIG. 5 is a transverse section, taken on the line 5—5 of FIG. 3*c*, showing the downhole pilot valve assemblies in top plan.
Figure 6A:
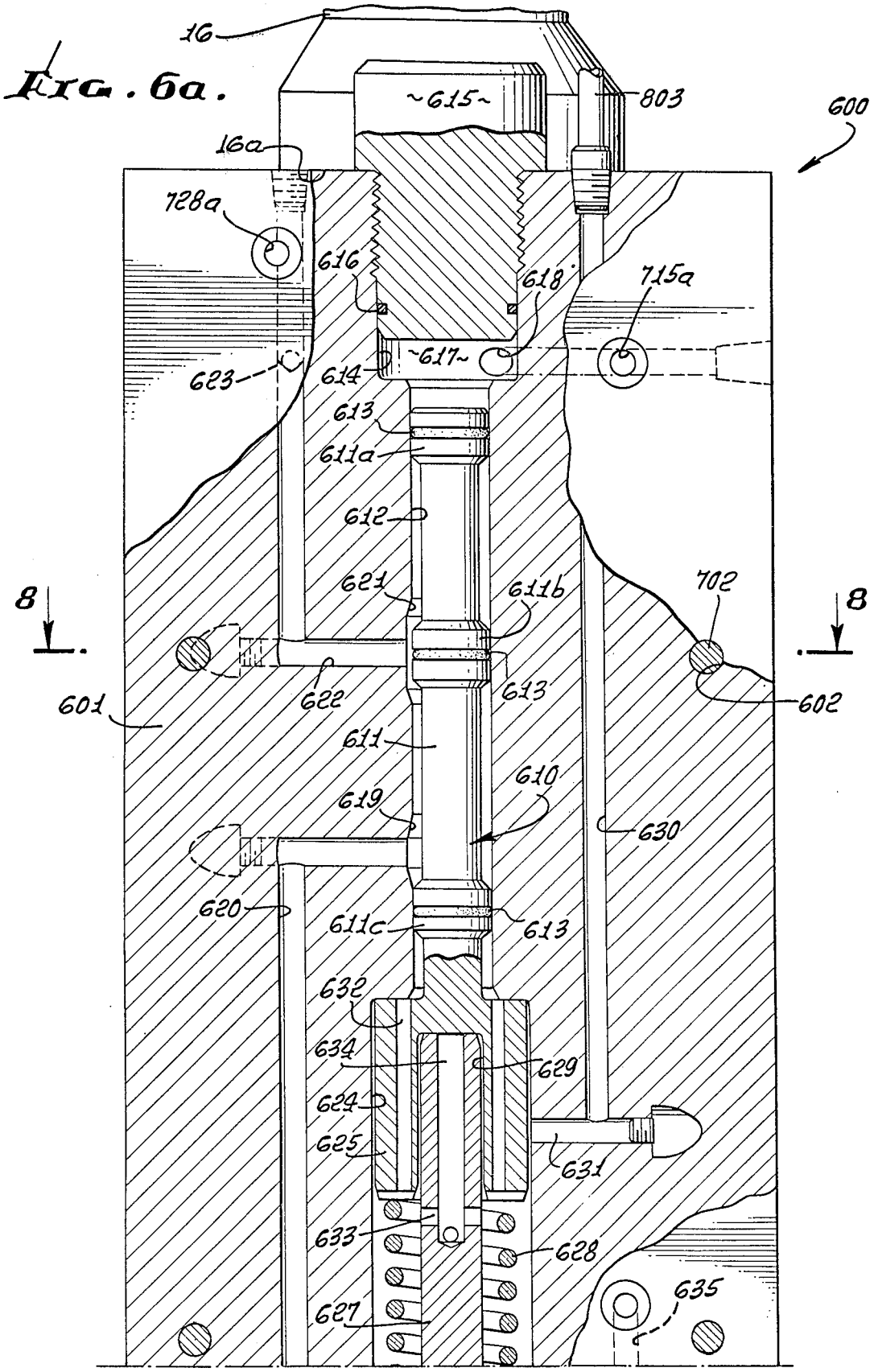
Figure 6B:
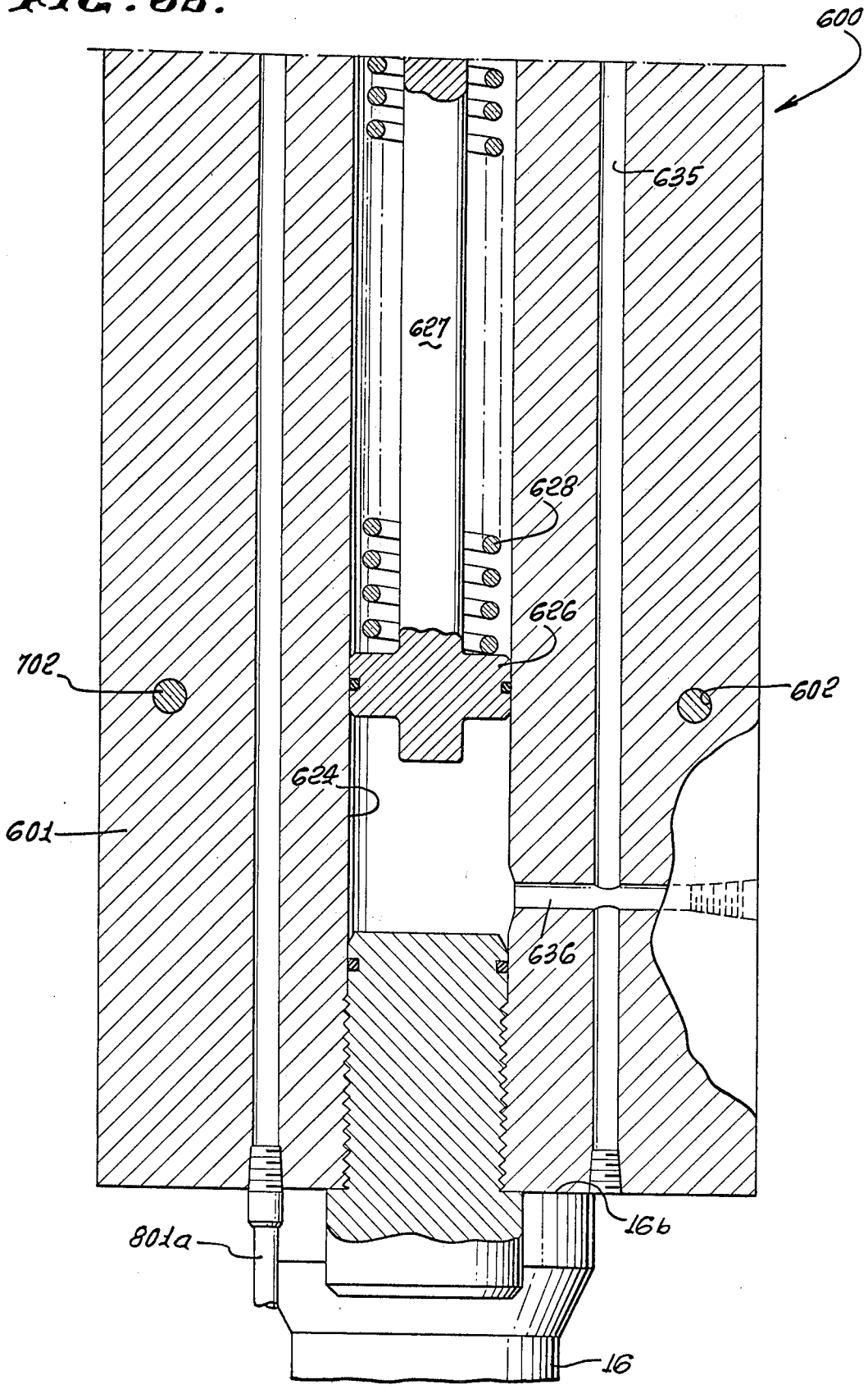

FIGS. 6*a* and 6*b*, together, constitute a vertical section, as taken on the line 6—6 of FIG. 5, showing the quick disconnect pilot valve means, FIG. 6*b* being a downward continuation of FIG. 6*a;*

Figure 7A:
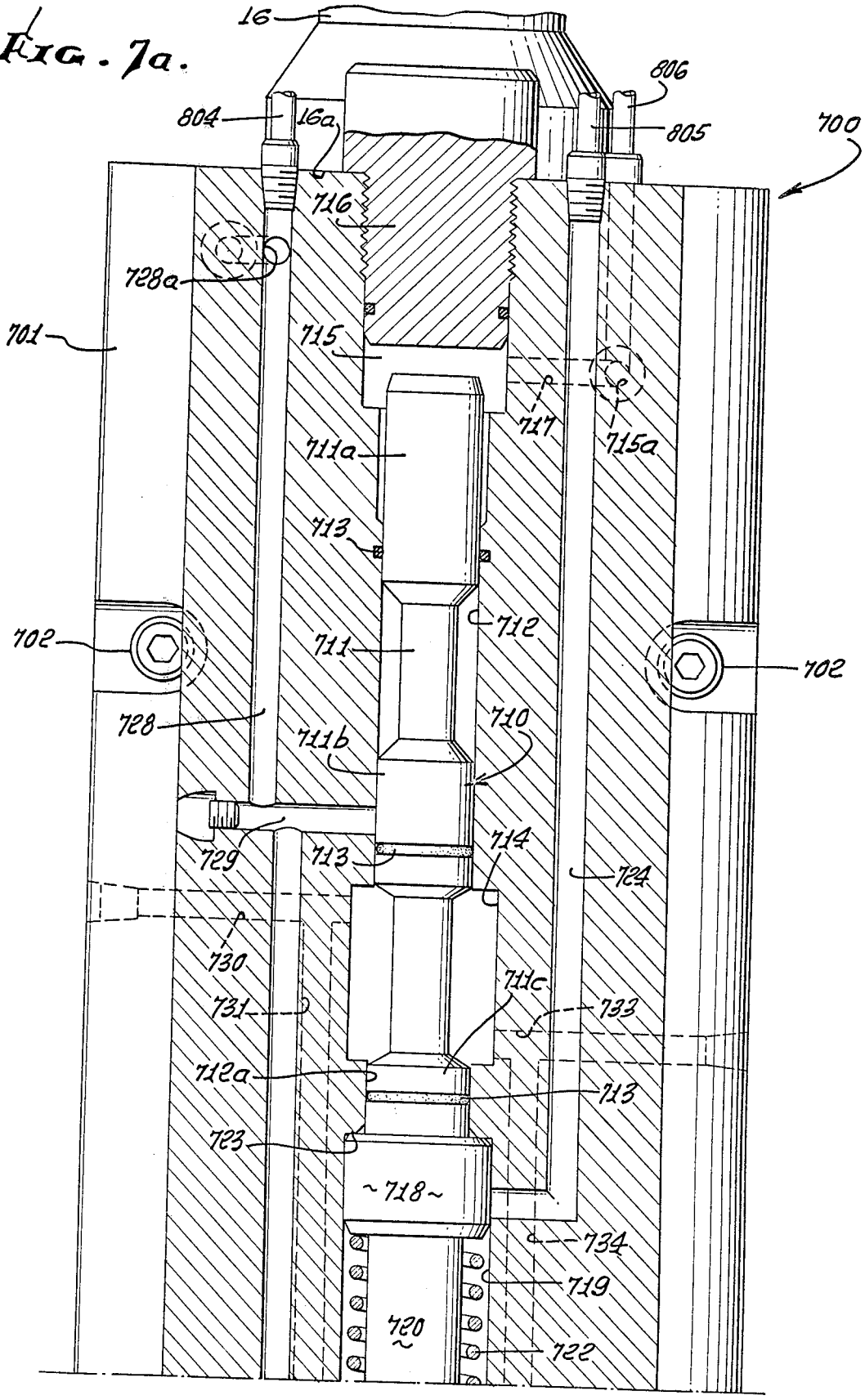
Figure 7B:
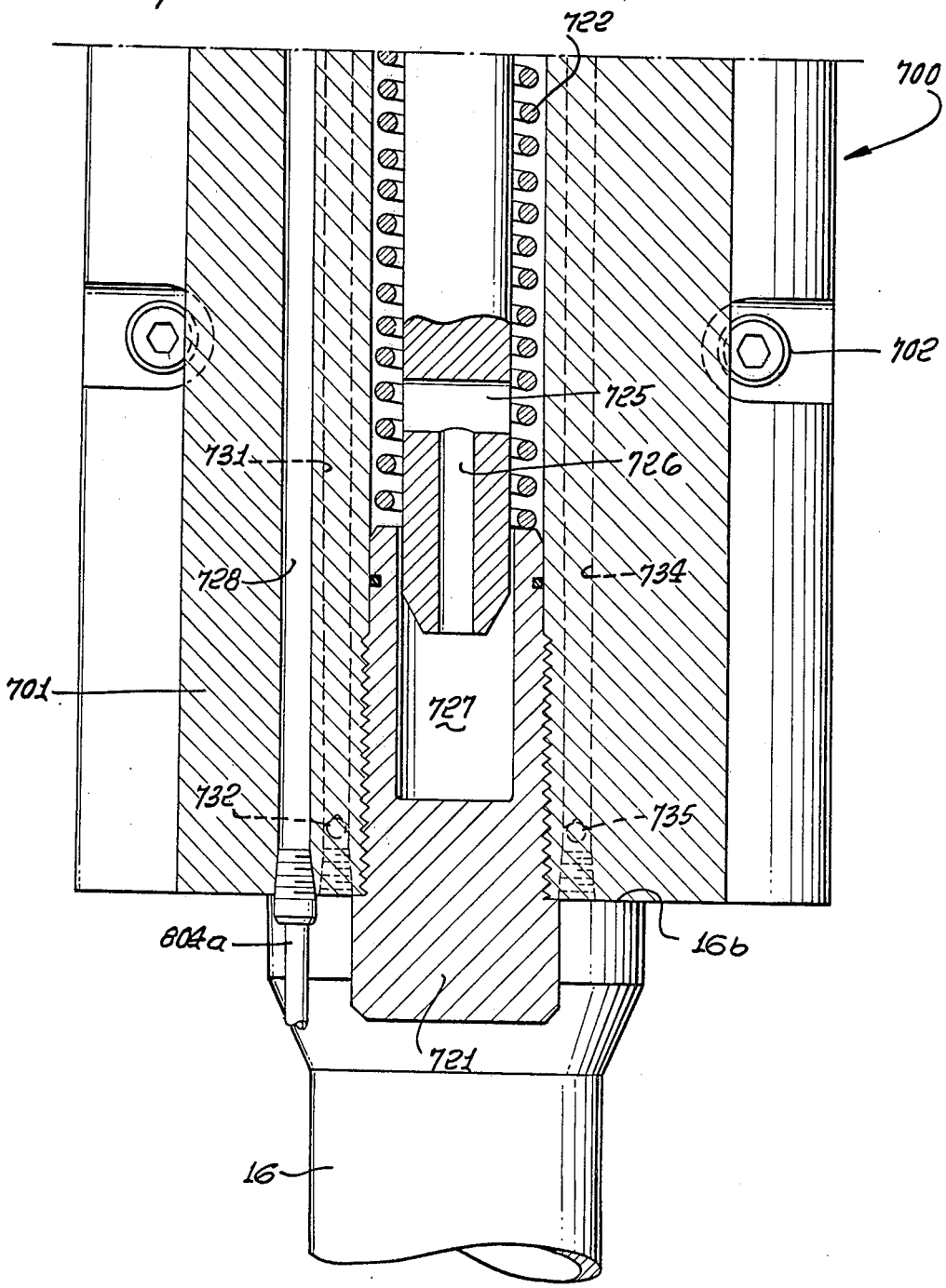

FIGS. 7*a* and 7*b*, together, constitute a vertical section, as taken on the line 7—7 of FIG. 5, showing the quck dump pilot valve means, FIG. 7*b* being a downward continuation of FIG. 7*a;*

Figure 8:
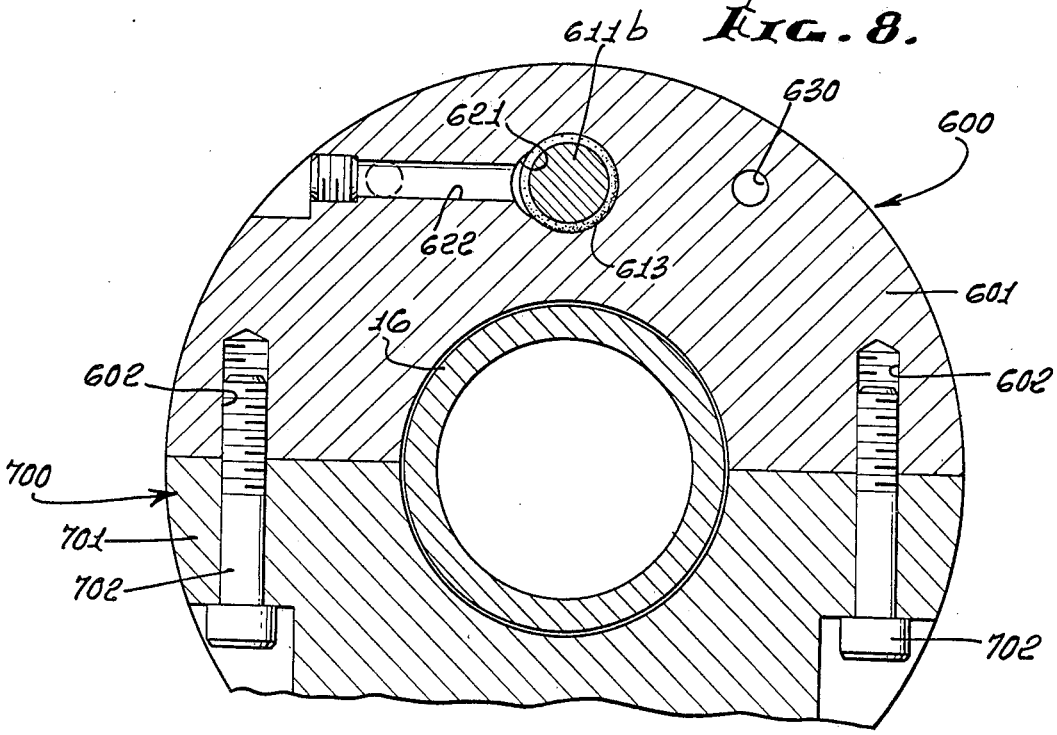

FIG. 8 is a fragmentary horizontal section, as taken on the line 8—8 of FIG. 6*a;*

Figures 3A, 3B, 4:
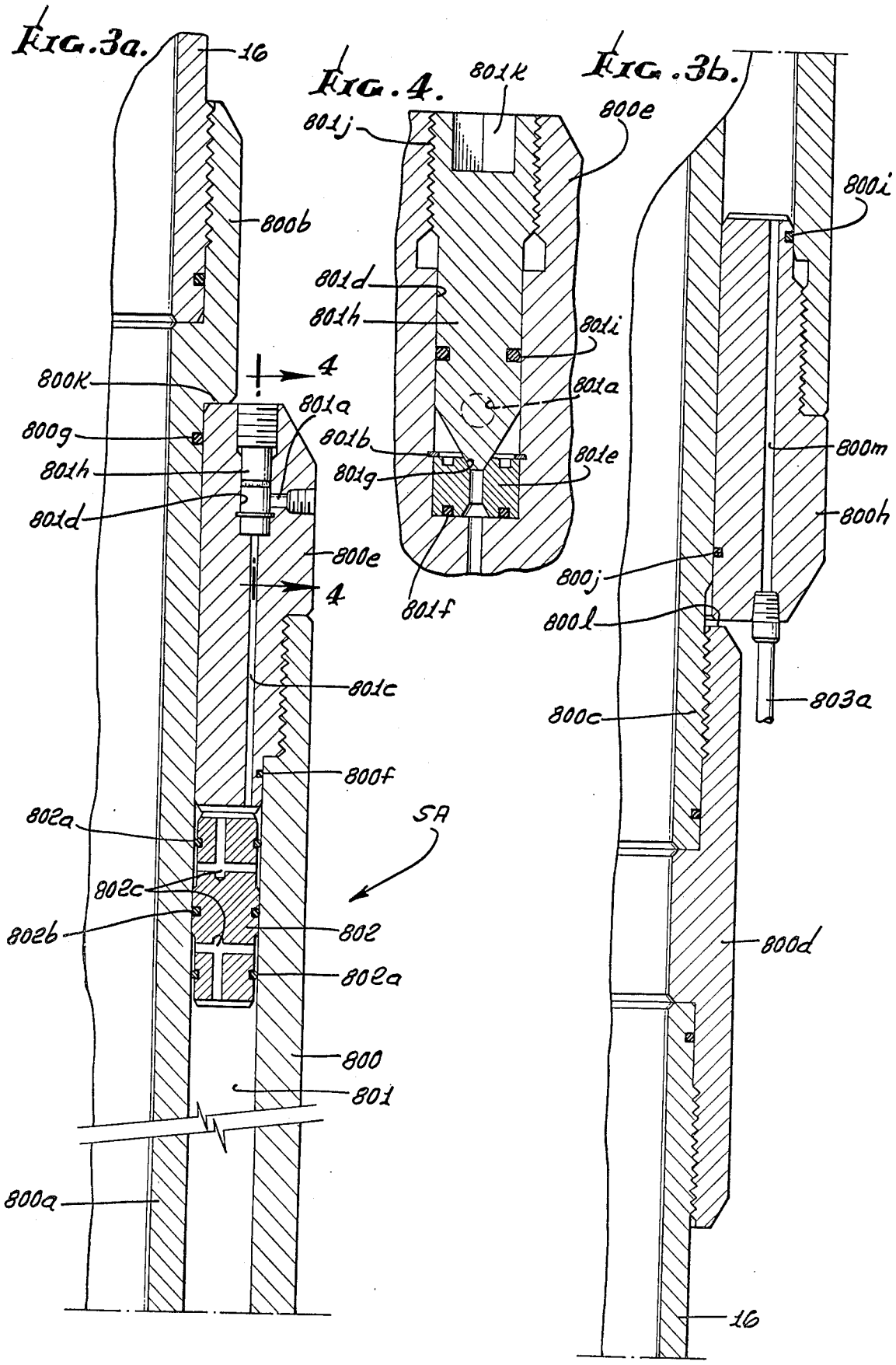
FIG. 4 is an enlarged fragmentary detail section, as taken on the line 4—4 of FIG. 3*a;*
Figure 3C:
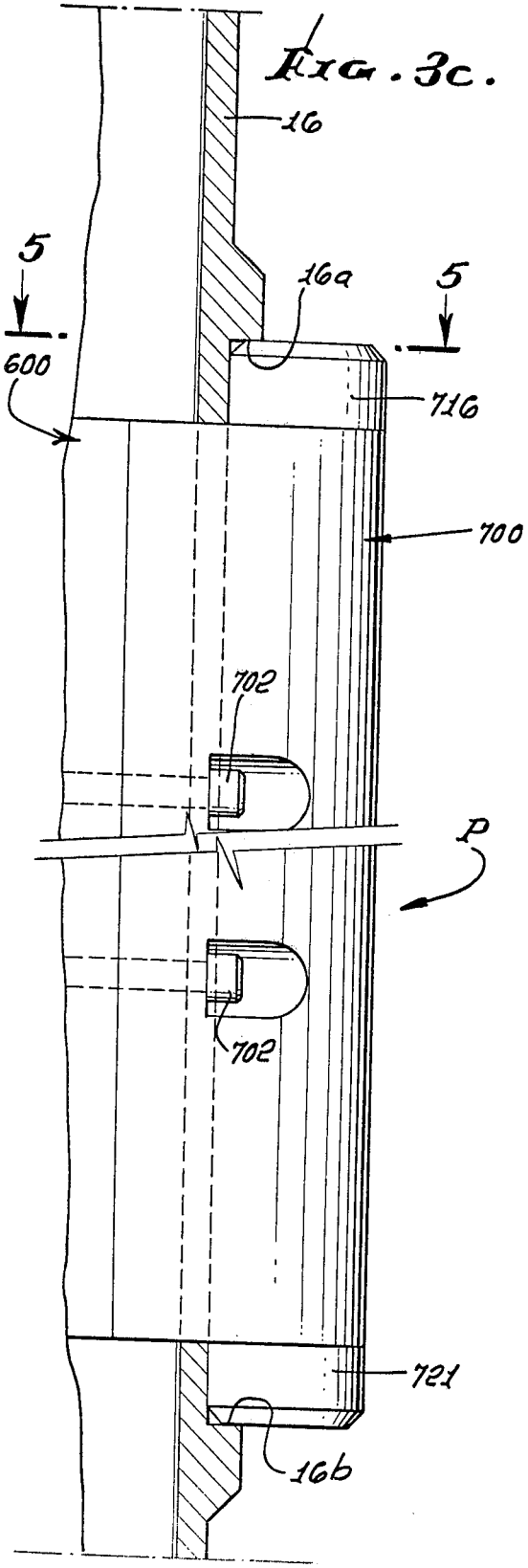
Figure 3D:
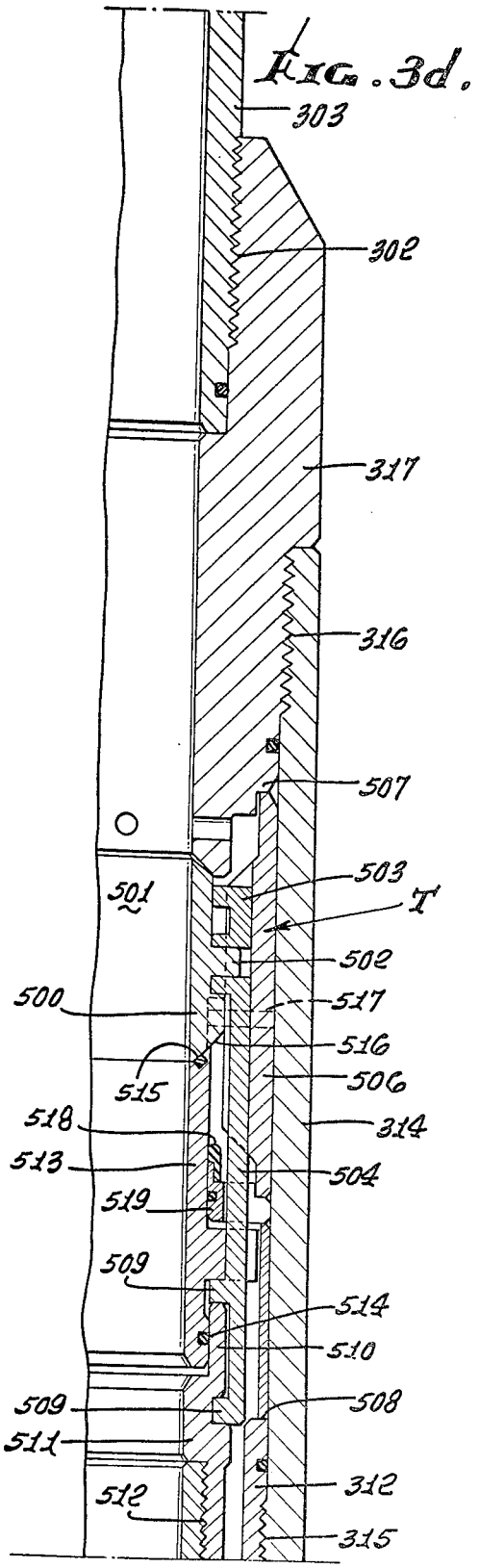
Figure 3E:
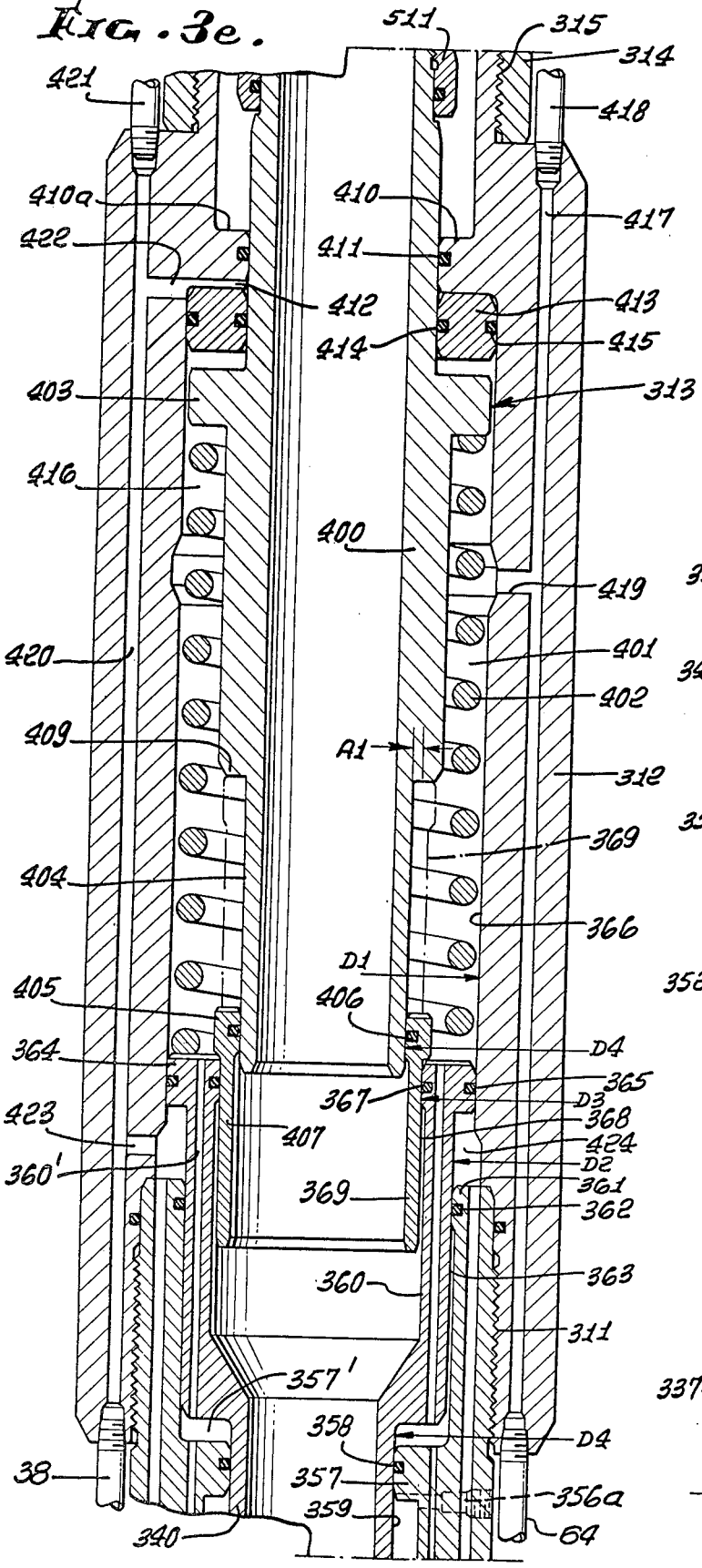
Figure 3F:
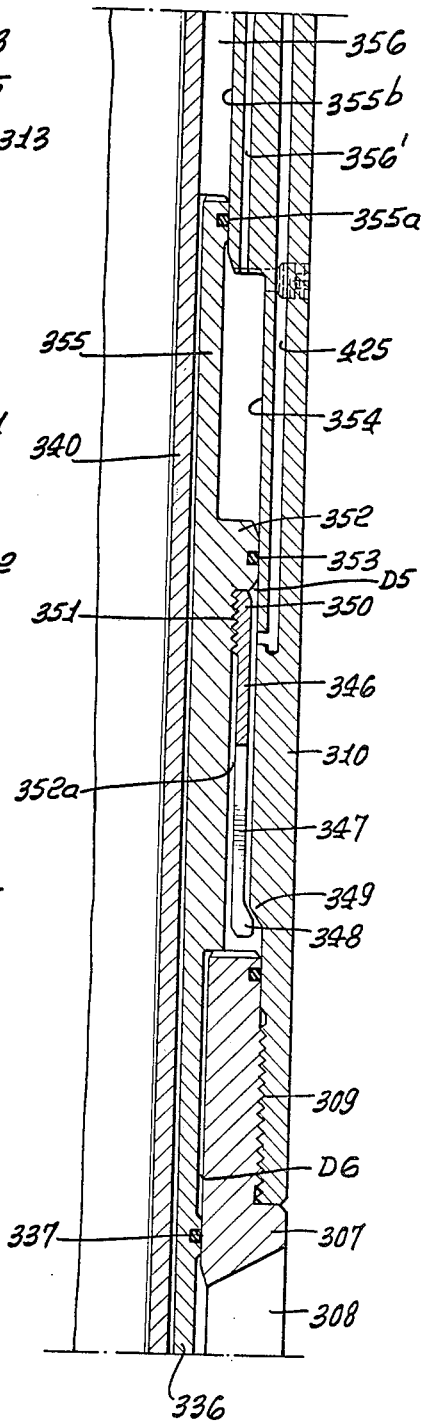
Figure 3G:
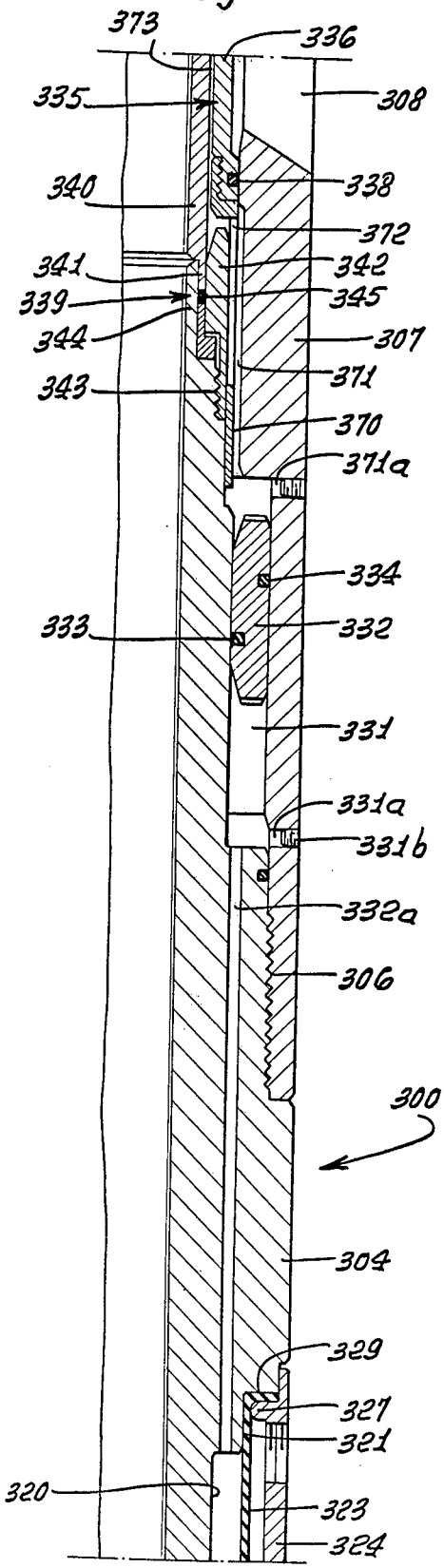
Figure 3H:
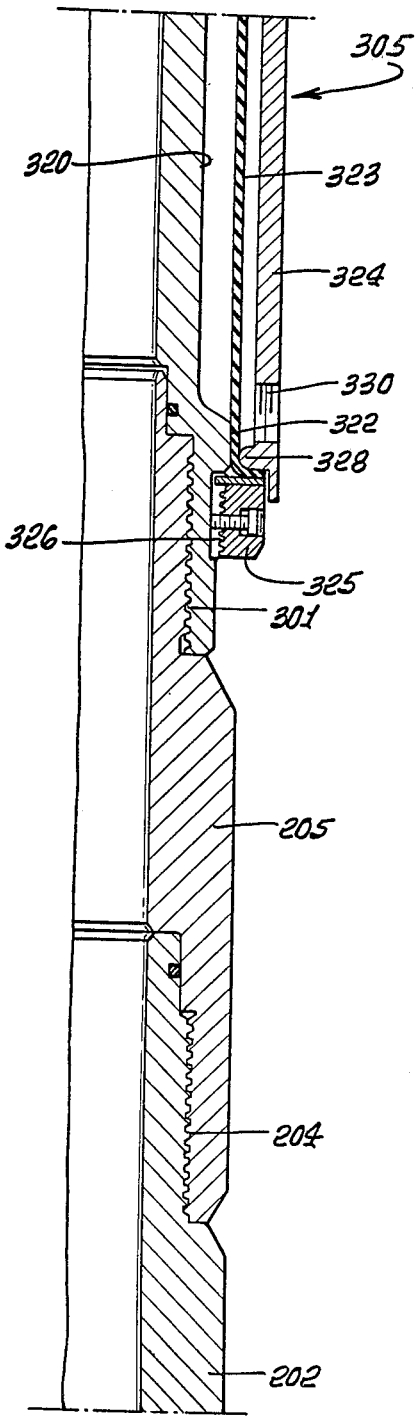
Figure 3I:
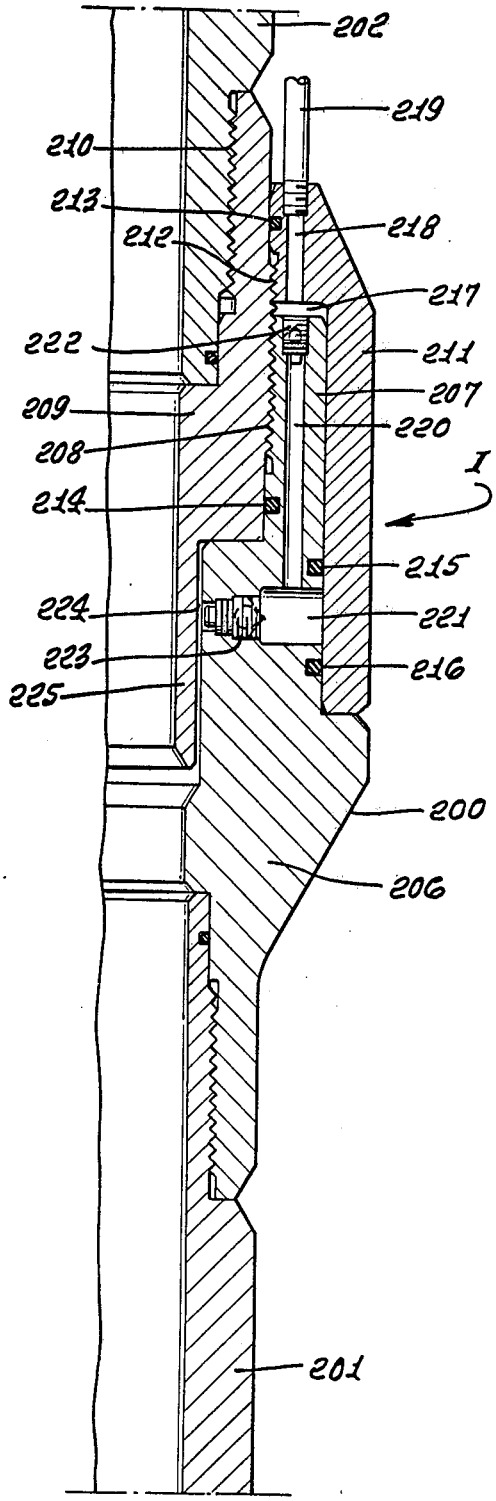
Figure 3J:
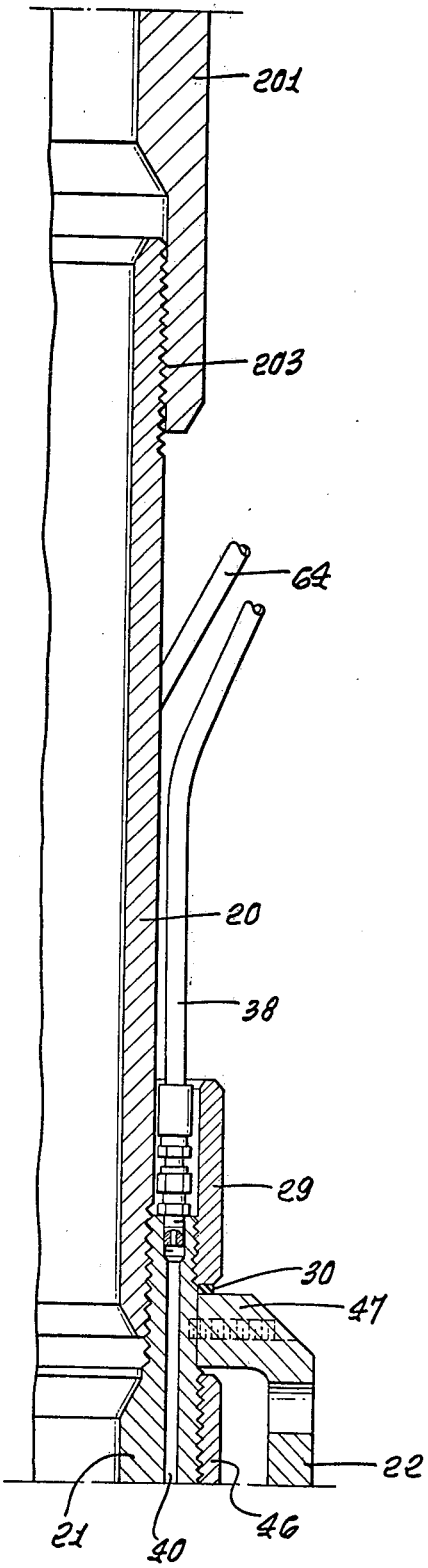
Figure 3K:
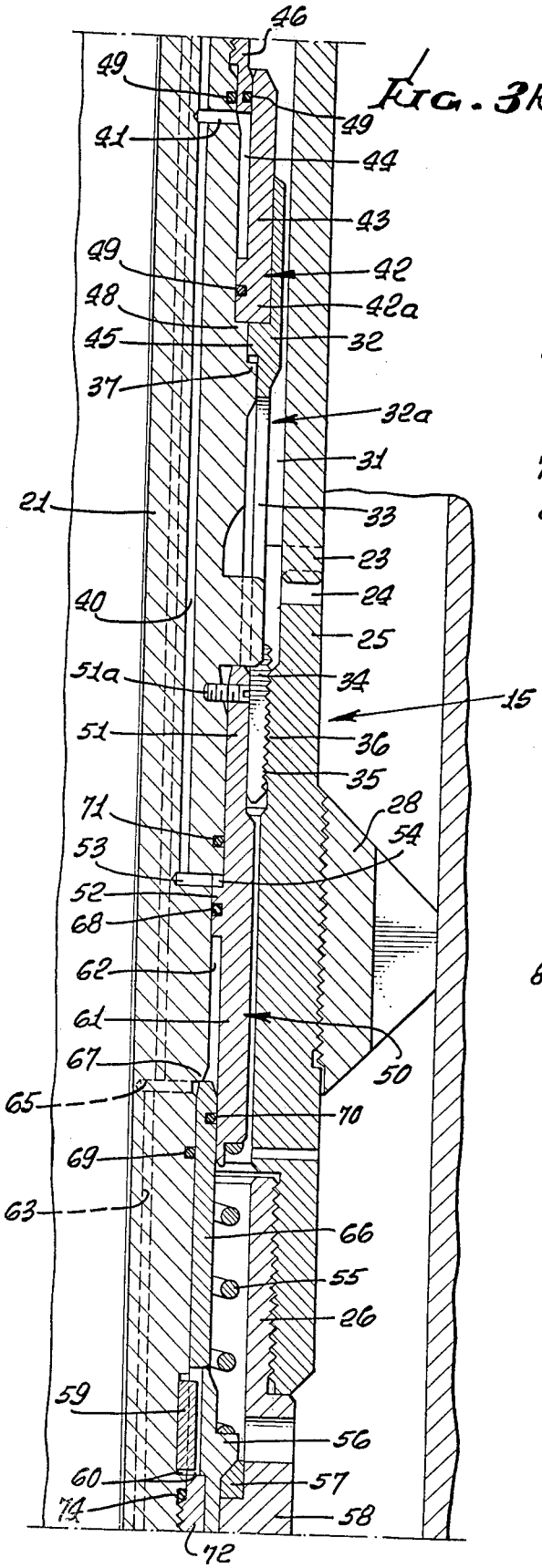
Figure 3L:
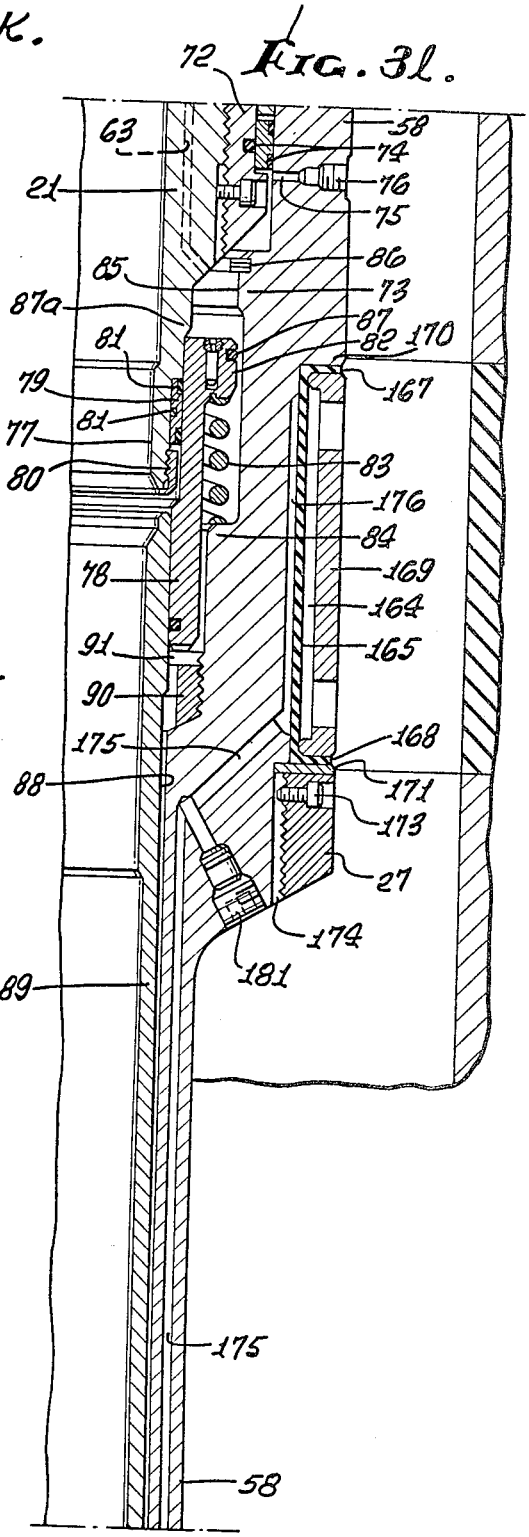
Figure 3M:
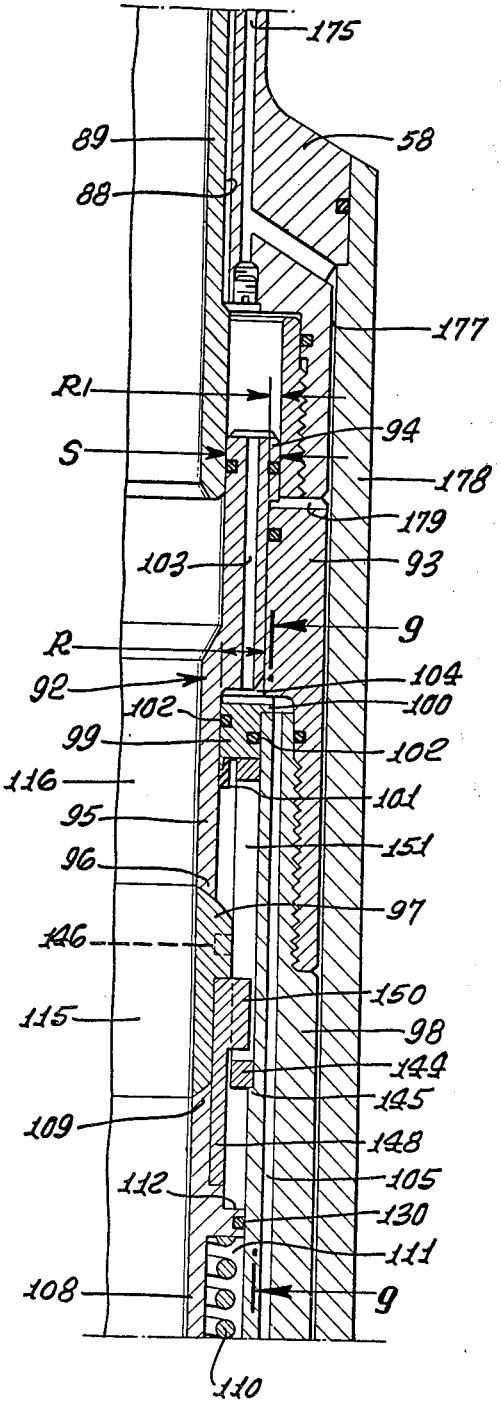
Figure 9:
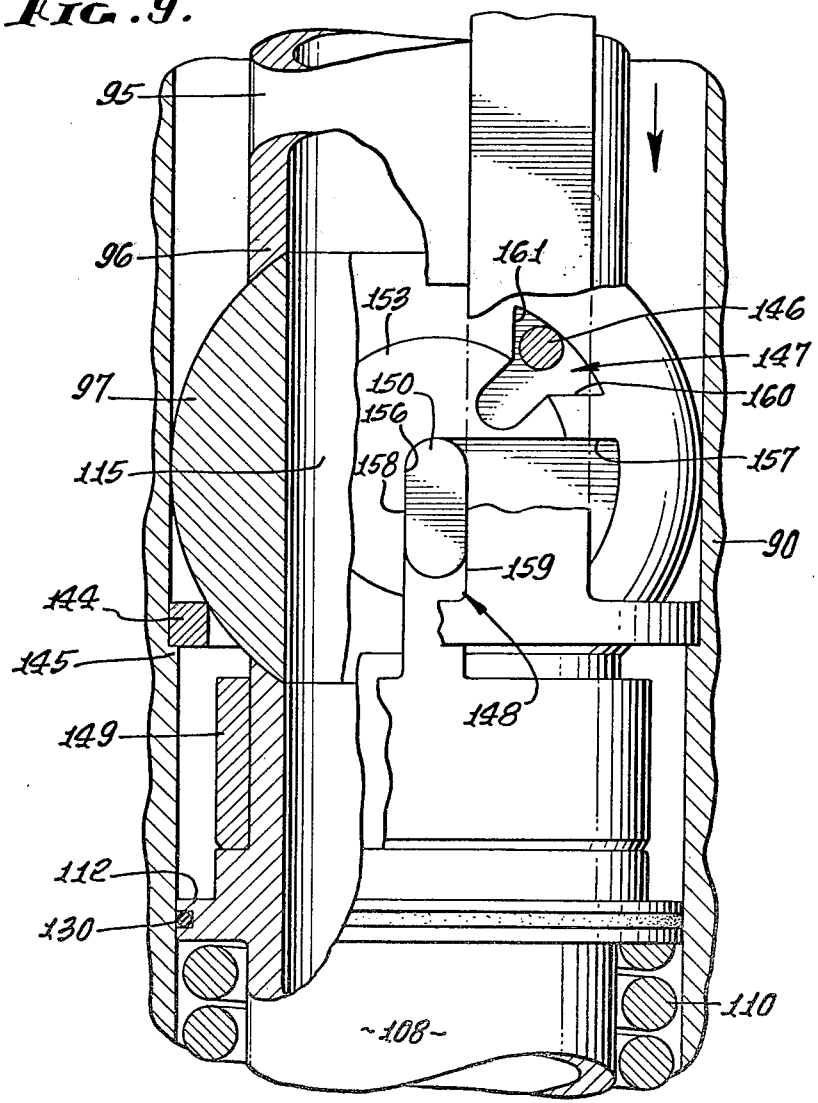
Figure 10:
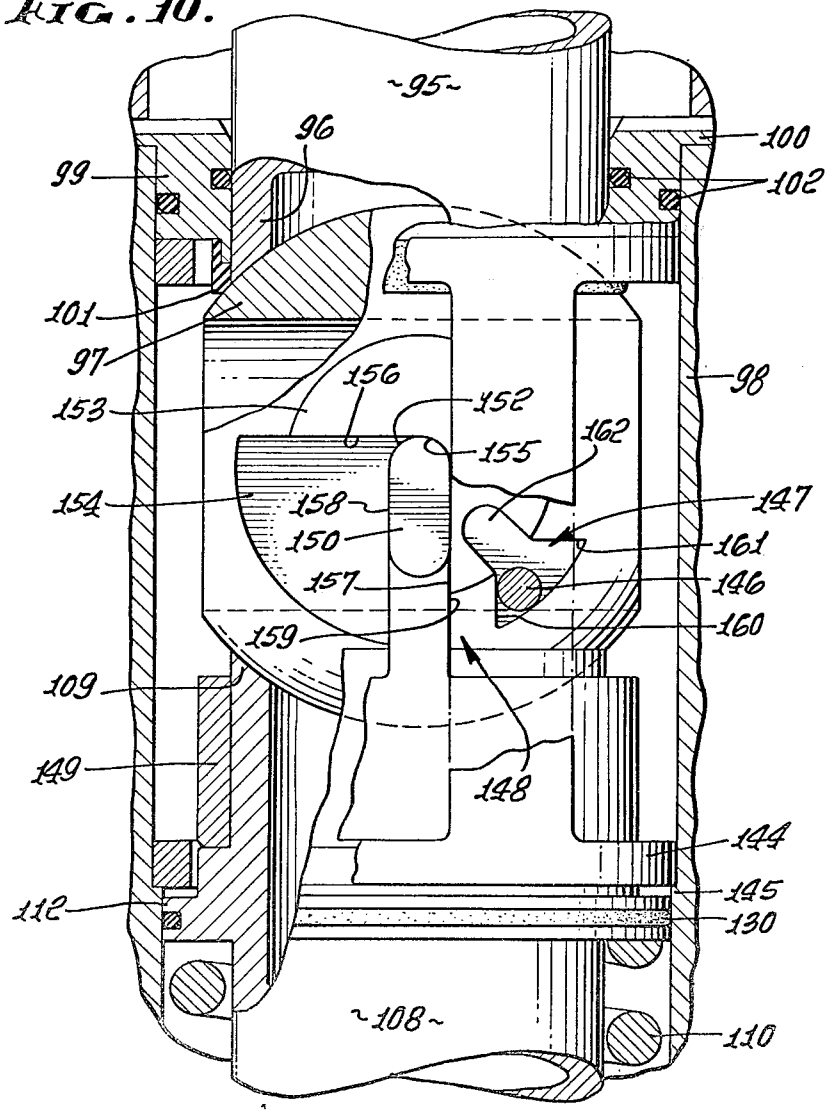
Figure 11A:
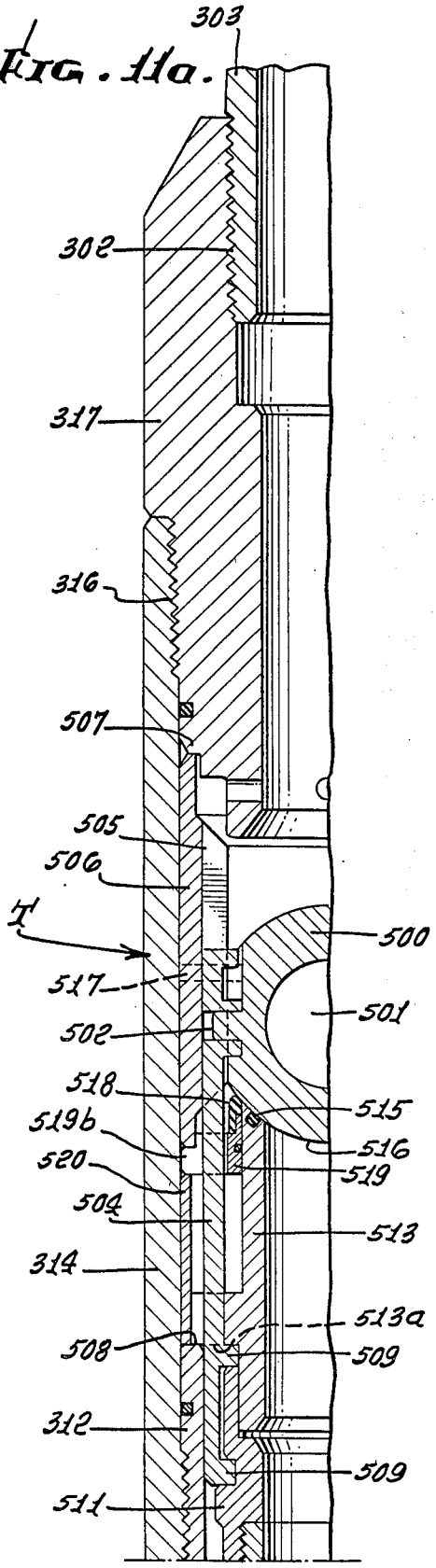
Figure 11B:
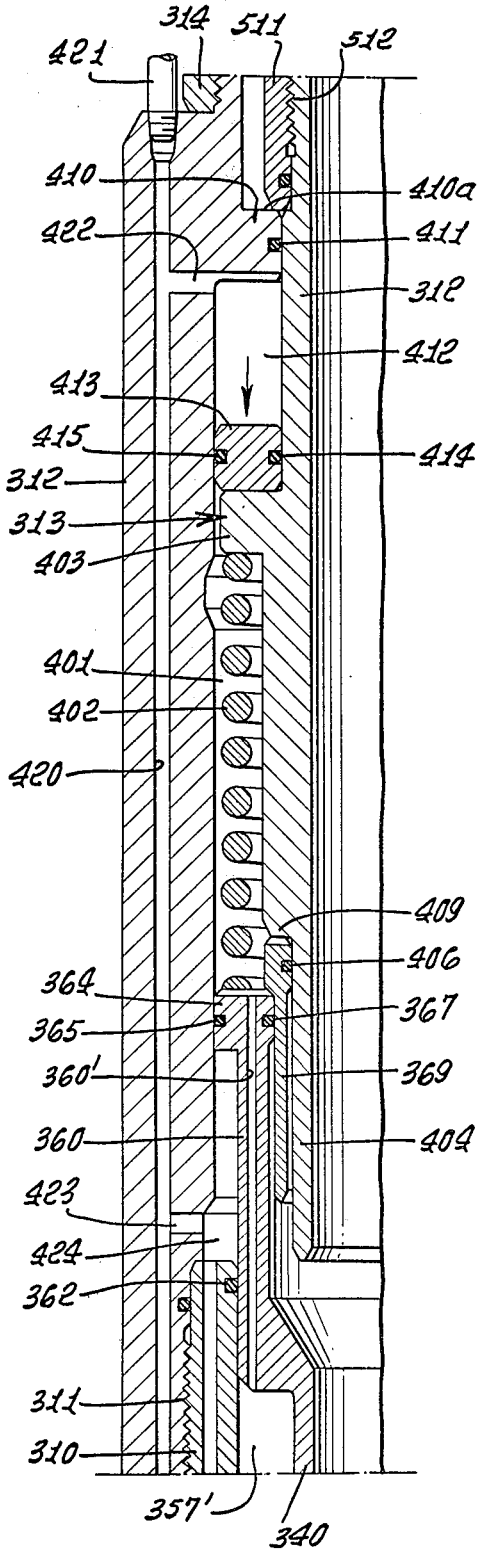
Figure 11C:
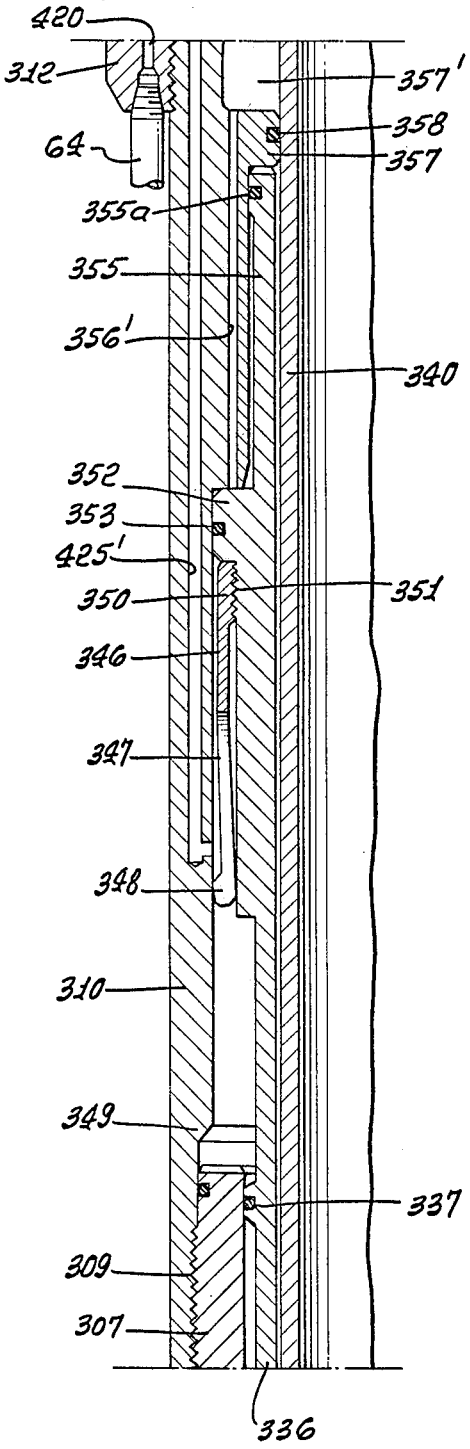
Figure 11D:
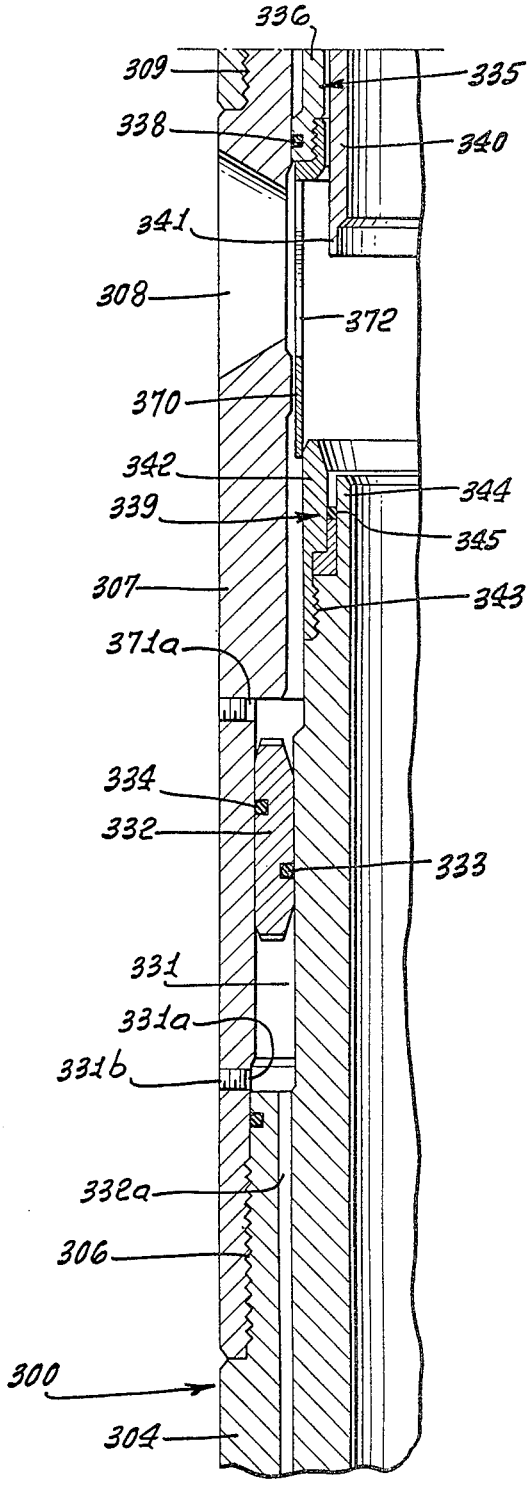

FIG. 9 is a fragmentary view, as taken on the line 9—9 of FIG. 3*m*, showing one of the test tree safety valves, partly in elevation and partly in section and in the open condition;

FIG. 10 is a view corresponding to FIG. 9, but showing the valve closed;

FIGS. 11*a* through 11*d*, together, constitute a longitudinal section showing the apparatus of FIGS. 3*d* through 3*g* in the shut-off and dump mode, FIGS. 11*b* through 11*d* being successive downward continuations of FIG. 11*a;*

Figure 12:
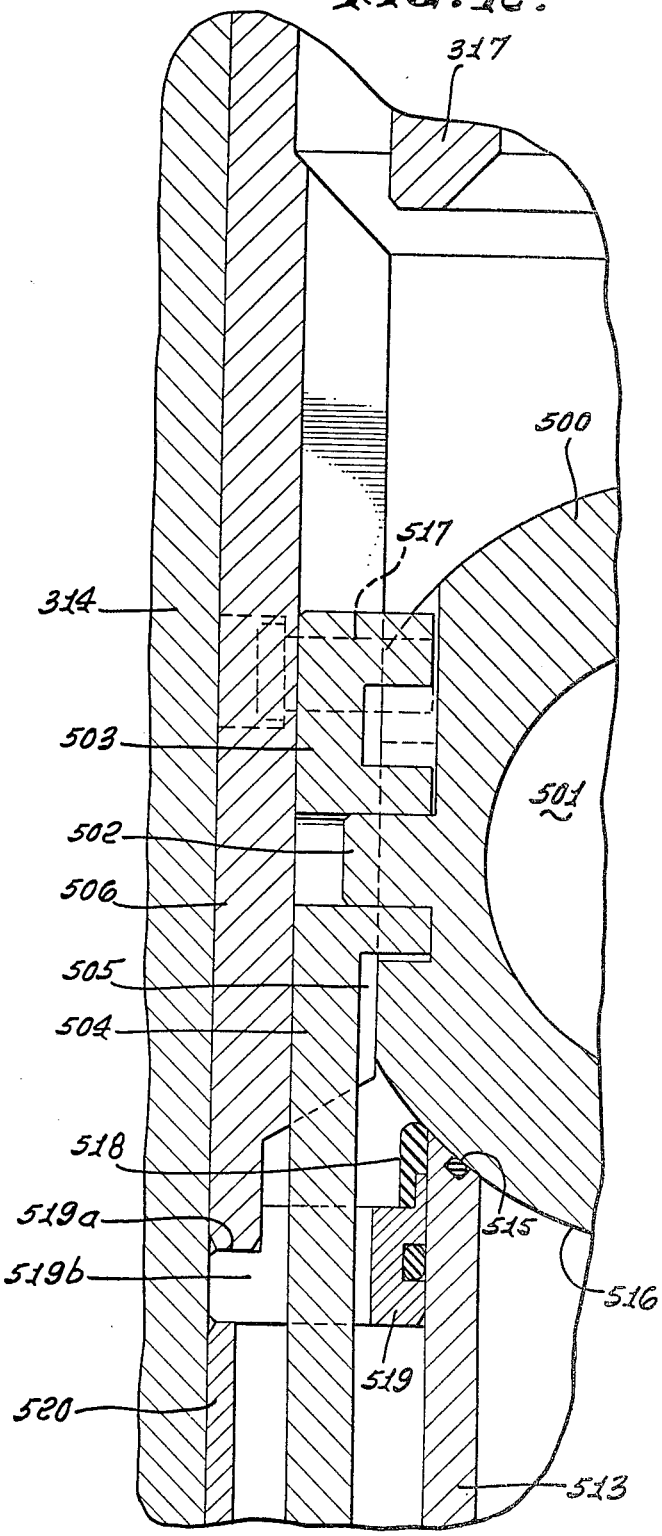
Figure 13A:
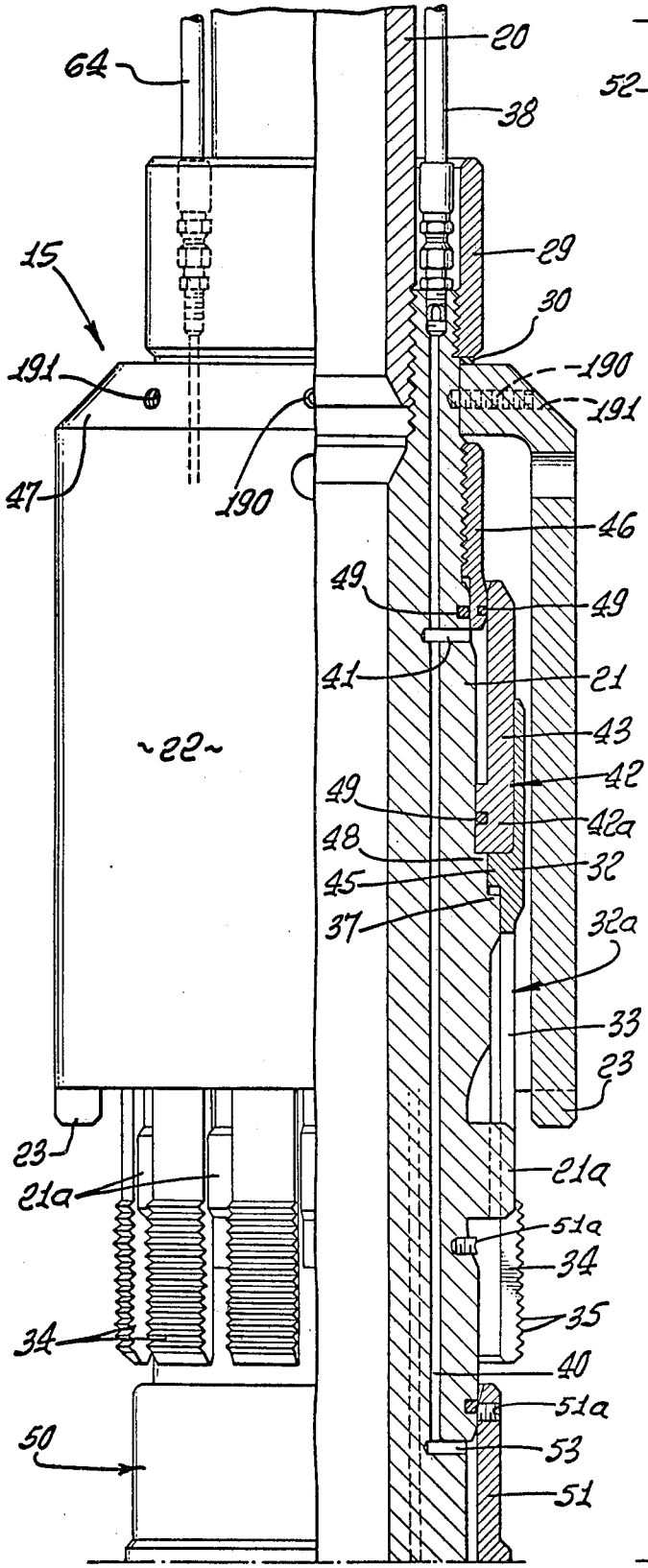
Figure 13B:
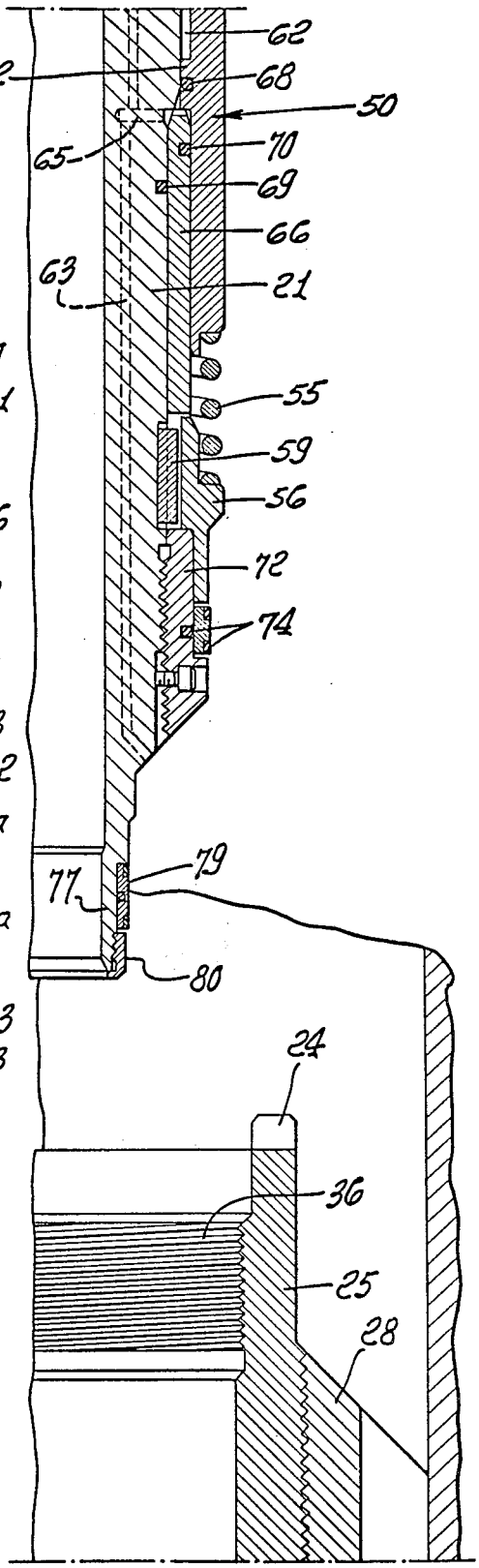

FIG. 12 is an enlarged fragmentary section showing the tubing shutoff ball valve in a closed position; and FIGS. 13*a* and 13*b*, together, constitute a fragmentary longitudinal section, showing the latch structure of FIGS. 3*k* and 3*l* in a disconnected condition.

As seen in the drawings, a removable underwater or subsea test valve apparatus A can be lowered from a platform or floating drilling vessel (not shown) through a marine riser B releasably connected to a casing hanger assembly C disposed at the subsea or ocean floor O, the test valve apparatus being positionable within a blowout preventer stack E. As shown, a plurality of casing hangers F are supported one upon each other, different size casing strings G depending from the hangers and extending into the well bore H extending downwardly from the ocean or subsea floor, all in a known manner. A tubular string J, such as drill pipe or tubing, extends into the well bore, being supported by a tubing hanger 10 resting upon a seat 11 of the uppermot casing hanger F. The test valve assembly A is suitably connected to the upper end 12 of the lower tubular string portion 13, this assembly including a subsea valve unit 14 having a valve that can be shifted between open and closed positions, and an upper latch mechanism 15 releasably securing an upwardly extended tubing valve assembly T to the test valve assembly A. Between the tubing valve T and the latch mechanism 15 is an injection valve assembly I. A pilot valve assembly P, claimed in this application, is carried by the pipe string above the tubing valve and injection valve, and a subsea pressure source or accumulator SA is carried by the upper portion 16 of the tubular string that extends through the marine riser B to the drilling vessel or platform.

With the test valve assembly A and the tubing valve assembly T latched together, the entire assembly can be lowered through the riser pipe on the upper tubular string 16 and landed in the casting hanger. Control lines CL extend upwardly from the accumulator and pilot valve assembly to the drilling vessel or platform at the surface of the sea to a suitable source of control fluid and to a control console CC, whereby the operation of the pilot valve assemblies, the test valve, the tubing valve, the latch and the injection valve can be controlled, as will be later described.

The blowout preventer stack E includes a plurality of blowout preventers E-1, E-2 of a known type or types, which are arranged in series and adapted to close around different diameters of tubular devices disposed therewithin. The uppermost blowout preventer E-2 consists of a blind ram adapted to be closed across the full diameter of the blowout preventer passage after the upper portion 16 of the tubular string, the injection valve I, the pilot valve assembly P and the tubing valve assembly T have been removed as described hereinbelow.

Referring to FIGS. 3*a* through 3*o*, the structure of the apparatus adapted to be lowered on the pipe 16 and landed in the casing hanger is shown in greater detail. Included in such apparatus, as best seen in FIGS. 3*j* through 3*o* are the valve unit 14 and the latch unit 15, which are more particularly disclosed in the prior U.S. Pat. No. 3,870,101.

THE DISCONNECT LATCH

The latch unit 15, as seen in FIGS. 3*j* through 3*l* has an upper body sub 20, the lower end of which is threadedly secured to a stinger body 21 disposed within an upper torque sub 22 having a plurality of clutch dogs 23 at its lower end adapted to coact with upwardly extending clutch dogs 24 on the upper end of a lower torque sub 25 forming part of the test valve apparatus. The lower torque sub is threadedly attached to an elongate landing head 26 carrying a bearing ring 57 thereon. A slotted body guide 28 is affixed to the torque sub 25. An upper torque sleeve 29 is adjustably and threadedly disposed on the upper portion of the stinger body 21, its lower end engaging a bearing 30 that bears upon the upper end of the upper torque sub 22.

Disposed in an annular space 31 between the stinger body 21 and the upper torque sub 22 is a latch device 32*a*, including an upper latch sleeve portion 32 from which depend a plurality of arms 33 terminating in lower threaded latch fingers 34 having external threads 35 thereon adapted to mesh with companion internal threads 36 in the lower torque sub 25. Preferably, the threads are left hand. Downward movement of the latch 32*a* is limited by engagement of its sleeve portion 32 with an upwardly facing shoulder 37 on the stinger body. The latch is urged downwardly of the stinger body hydraulically by virtue of fluid under pressure conducted through a latch control line 38, extending through the annular space 39 in the marine riser from the pilot valve assembly P and communicating with an elongate passage 40 in the stinger body. A side port 41 extends from the passage 40 to the interior of a latch return piston 42 slidable along the periphery of the stinger body and an upper skirt portion 43 spaced from the periphery of the latch body to provide an annular space 44 communicating with the port. The piston 42 is disposed within the latch sleeve 32, its lower end engaging an internal flange 45 of the latter. The piston 42 is also slidable along a spacer sleeve 46 fixed to the body 21, the upper end of which is disposed below an inwardly directed flange 47 of the upper torque sub. Downward movement of the piston 42 along the stinger body is prevented by its engagement with a companion upwardly facing shoulder 48 on the body. Suitable seals 49 are provided between the stinger body 21 and the spacer sleeve 46 and piston 42, head 42*a* and also between the spacer sleeve 46 and the piston skirt 43 to prevent fluid leakage from the annular piston chamber 44. Upon applying pressure to the fluid in the latch control line 38 and piston chamber 44, the latch return piston 42 is urged in a downward direction forcing the latch 32*a* itself to its lowermost positon along the stinger body 21.

The latch mechanism includes a latch lock piston 50 shiftable longitudinally along the stinger body and having an upper portion 51 adapted to be disposed behind the latch fingers 34 to retain them fully meshed with the internal threads 36 of the lower torque sub 25. The upper portion 51 of the latch piston is slidable along the stinger body 21, the piston including an inwardly directed head 52 slidable along a smaller diameter portion of the stinger body. A side port 53 extends from the fluid passage 40 in the body into the annular space 54 between the body and the latch lock piston head. Shear pins 51*a* or other frangible means connect the latch lock piston 50 to the stinger body 21 and initially hold the piston in its upper position, preventing release of the latch fingers 34. When pressure is applied to the fluid in the latch control line 38 and the passage 40 communicating therewith, such pressure must cause shearing of the holding pins 51*a* before the latch lock piston 50 shifts downwardly from its locking position behind the latch fingers 34, freeing the latter and permitting them to flex inwardly and out of meshing engagement with the internal threads 36 in the lower torque sub. Such downward movement of the latch lock piston occurs against the force of a helical compression spring 55, the upper end of which engages the piston 50, and the lower end of which engages a stinger bearing flange 56 seated upon a bearing ring 57 carried in the upper portion 58 of the landing head 26. Torque can be transmitted from the stinger body 21 to the stinger bearing flange 56 through a key 59 fitting into opposed grooves 60 in the bearing and the stinger body.

The lock piston 50 has a lower skirt 61 depending from its head 52 and providing with the stinger body an annular space 62 into which fluid can pass from a valve control passage 63 communicating with a control line 64 connected to the upper portion of the stinger 21 and which extends upwardly through the annular space 39 in the marine riser B to the pilot valve assembly P. The passage 63 in the stinger body (only the lower portion of which is shown) has a side port 65 communicating with the annular space 62 between the lower piston skirt 61 and the stinger body 21, such that fluid under pressure shifts the latch lock piston 50 upwardly to its locked position behind the latch fingers 34 to retain the latter meshed with the internal threads 36 in the lower torque sub 25. The lower lock piston skirt 61 is slidable downwardly along a spring guide 66 surrounding the stinger body, the upper end of this guide enagaging a shoulder 67 on the stinger body, the lower end engaging the upper end of the stinger bearing 56. Fluid under pressure in the control passage 63 and annular space 62 is prevented from leaking from such space by a suitable seal ring 68 on the piston head slidably and sealingly engaging the periphery of the stinger body, by a seal ring 69 on the stinger body engaging the spring guide 66, and by a seal ring 70 on the spring guide in relative slidable engagement with the inner wall of the lower piston skirt 61. Similarly, fluid under pressure is prevented from leaking upwardly between the upper lock piston skirt 51 and the stinger body 21 by a side seal 71 on the latter sealingly engaging the upper skirt. The spring guide 66 and stinger bearing 56 are retained in appropriate position by a seal retainer 72 threaded on the stinger body and bearing against the stinger bearing to hold the latter against the spring guide, which, in turn, engages the body shoulder 67.

The control passage 63 extends downwardly within the stinger body and opens (FIG. 3*l*) into an upper valve head portion 73 of the landing head 58. Fluid from the control passage entering the head 73 is prevented from leaking upwardly by suitable seal rings 74 between the body and seal retainer 72, between the seal retainer and stinger bearing 56, and between the latter and the landing head 58. To facilitate the filling of the control passage 63 with fluid a port 75 is provided, adapted to be closed by a suitable pipe plug 76, and extending from the exterior of the landing head 58 to a position communicating with the head 73.

The lower end 77 of the stinger body 21 is of reduced diameter, being adapted to fit into an annular poppet or piston valve 78 mounted in the landing head 58. A sleeve 79 surrounds the reduced end 77 and is retained in position by a suitable retainer 80 threaded on the lower end of the body. This sleeve carries internal and external seals 81 to prevent leakage therearound when the lower portion 77 of the stinger body is disposed within the poppet or piston valve member 78.

The poppet valve includes an upper head 82 movable upwardly by a helical compression spring 83 extending between a lower spring seat 84 on the landing head and the head 82, urging the latter upwardly towards a cylindrical seat 85 in the landing head portion 73, upon removal of the stinger, such upward movement being limited by engagement of the valve head 82 with a suitable snap retainer ring 86 disposed in the landing head. A seal ring 87 on the head engages the seat to prevent leakage therearound. When the stinger body 21 and the parts carried thereby are lowered into the lower torque sub 25 and landing head 58, the lower portion 77 of the stinger body becomes piloted in the poppet valve member 78, its shoulder 87*a* engaging the upper end of the valve member and shifting it downwardly against the force of the spring 83 out of engagement with its companion seat 85, permitting fluid in the control line passage 63 to flow around the poppet valve head 82 and into an annular passage 88 provided between the landing head 58 and a connector sleeve 89 disposed within the latter, this connector sleeve also extending upwardly within the poppet valve member 78. A ring 90 is threaded into the landing head which has radial slots 91 therethrough, and which is engaged by the poppet valve 78 to limit downward movement of the latter, while permitting fluid to flow into the annular space 88 between the connector sleeve and the landing head.

THE SUBSURFACE SAFETY VALVE

The lower portion of the connector sleeve 89 described above is disposed within an upper annular piston 92 slidable longitudinally within an upper piston housing 93 threadedly secured to the lower end of the landing head 58. The upper head 94 of this piston is slidable along its housing 93 and also along the connector sleeve 89, a lower skirt portion 95 spaced inwardly from the piston housing 93 providing an upper seat 96 engaging an upper ball valve member 97 rotatably supported within an upper ball housing 98 which is threadedly secured to the lower portion of the piston housing 93. The lower skirt 95 is slidable downwardly within a resilient seal retainer ring 99 having an upper flange 100 engaging the upper end of the ball housing and carrying a lower elastomer seal ring 101 adapted to engage the periphery of the spherical or ball valve member. Suitable inner and outer seals 102 are provided on the retainer ring 99 for sealing engagement with the piston skirt 95 and with the upper ball housing 98. A longitudinal passage 103 extends through the piston 92 from its upper head to the location of its skirt, permitting the control fluid to pass from the upper passage 88 into the annular space 104 between the skirt and piston housing, from where the fluid can flow laterally of the seal ring 99 into a control passage 105 extending through the upper ball housing 98 and into an annular cylinder 106 provided between a lower piston housing 107 threadedly secured to the upper ball housing 98 and a follower sleeve 108 having a seat 109 on its upper end adapted to engage the periphery of the upper ball 97.

A helical compression spring 110 is disposed in an annular space 111 between the follower sleeve and the upper ball housing 98, its lower end bearing against the latter and its upper end against a downwardly facing flange 112 of the follower sleeve. This sleeve has ports 113 extending through its wall to permit free passage of fluid between its interior and the annular space 111 containing the spring, which tends to shift or translate the upper ball 97 longitudinally within its ball housing, whereas the pressure acting on the upper piston 92 tends to shift the ball longitudinally downwardly within the housing 98. During such upward and downward longitudinal shifting of the ball, it rotates between open and closed conditions to open the passage 114 through the follower sleeve, the passage 115 through the ball, and the upper piston 116, or to prevent fluid from flowing between the upper follower sleeve passage 114 and the upper piston passage 116.

The follower sleeve 108 is piloted within a lower annular piston **92*a* disposed in the annular or cylinder space 106, the lower piston having an annular head 94*a* sealingly engaging the lower piston housing 107 and follower sleeve 108, and a reduced diameter lower skirt 95*a* engaging a lower ball valve member 97*a* disposed within a lower ball housing 98*a* threadedly secured to the lower piston housing 107 to a bottom sub 120. The lower ball housing 98*a* contains a lower ported follower sleeve 108*a* and a helical compression spring 110*a* tending to urge the sleeve in an upward direction. Fluid can flow through a passage 103*a* extending through the lower piston 92*a* into the annular space 104*a* between its skirt and the lower piston housing, such fluid then being capable of passing through a longitudinal passage 121 extending through the lower ball housing 98*a* and into the sub 120** therebelow.

Figure 3N:
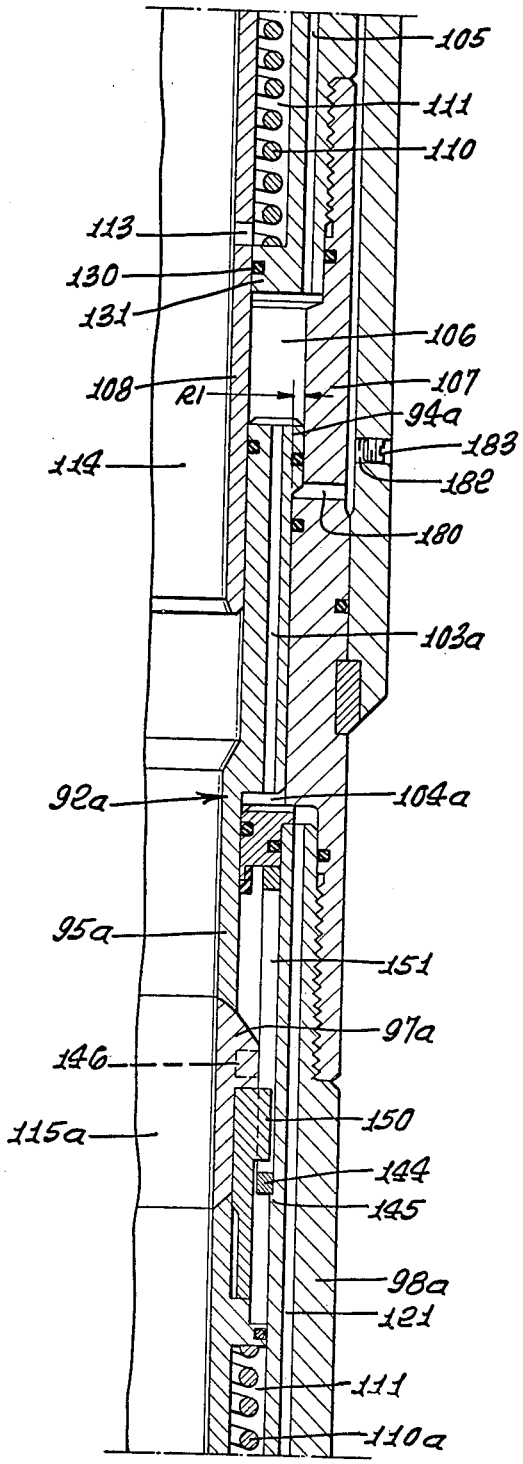
Figure 30:
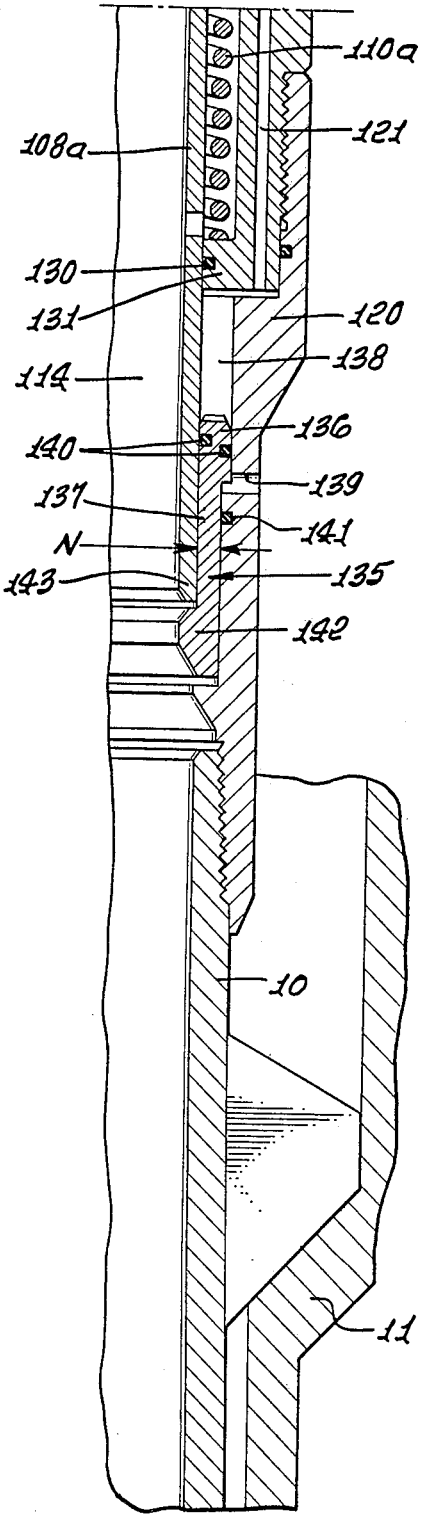

The lower ball valve assembly is essentially a duplicate of the upper ball valve assembly, making a detailed description of the lower ball valve assembly unnecessary to an understanding of the structure. It is sufficient to point out that suitable seal rings are provided between each control piston **92, 92*a* and its companion housing 93, 107 and sleeve 89, 108 to prevent leakage of control fluid past the interiors and exteriors of each piston. It is further to be noted that the annular area S of each piston head 94, 94*a* across which control fluid under pressure can act is substantially greater than the area R of the annular space between the piston skirt 95, 95*a* and opposed housing wall providing a differential area R1, at the upper portion of each piston, across which control fluid under pressure can act for the purpose of shifting the piston downwardly within the housing, and, in so doing, longitudinally shifting its campanion ball 97, 97*a*, and parts associated therewith, and the follower sleeve 108, 108*a* downwardly against the force of the spring 110, 110*a*, for the purpose of rotating the ball to its passage opening position, as illustrated in FIGS. 3*m* and 3*n*. Relieving of the control fluid pressure will permit each spring 110, 110*a* to act through its follower sleeve 108, 108*a* and shift the ball upwardly within its companion housing, as well as shifting its associated piston 92, 92*a* upwardly, whereupon the ball will rotate to its closed position (FIGS. 9 and 10**).

Suitable seal or wiper rings 130 are provided between each follower sleeve flange and its associated ball housing **98, 98*a*, between the lower portion of each follower sleeve and rearwardly directed flange portion 131** of each ball housing to prevent eddy currents.

The bottom sub 120 has an annular tubing piston 135 therein that has an upper head 136 slidable along the wall of the bottom sub, and also along the periphery of the lower follower sleeve **108*a*. This piston has a skirt portion 137 of a smaller external diameter than the piston head 136, providing an annular chamber 138 communicating through a port 139 with the exterior of the sub 120. Suitable inner and outer seal rings 140 are provided on the tubing piston head to prevent fluid leakage internally and externally of such head, whereas the bottom sub has a seal ring 141 therein, below its port, slidably and sealingly engaging the periphery of the skirt 137. The control fluid in the passage 121 can act downwardly on the tubing piston shifting it to its downward position when the ball valves have been opened. The tubing piston has an inwardly directed flange 142 adapted to engage the lower end 143 of the lower follower sleeve 108*a*, such that upward shifting of the tubing piston 135 will cause it to move the follower sleeve 108*a* upwardly. This action can occur in the absence of control fluid pressure, the well pressure within the tubing string 13 acting over the area N of the tubing piston to shift it upwardly, and thereby cause it to shift the follower sleeve 108*a* upwardly. In the event that such pressure is insufficient to shift the follower sleeve upwardly to the desired extent, the pressure in the annulus 39*a*** between the tubular string and the marine riser below the blowout preventer can be increased, such pressure being imparted through the port 139 to the piston skirt and acting on its head 136 to shift the piston upwardly.

In order to support each ball valve 97, 97*a* and cause rotation thereof between its piston 92, 92*a* and sleeve 108, 108*a*, a cage 144 is mounted within the housing 98, 98*a* between a housing shoulder 145 and the retainer ring 99. Affixed to the cage are diametrically opposed pins 146 fitting within opposed slots or notches 147 in the ball valve, the pins being offset from the rotational axis of the ball 97, 97*a* for the purpose of rotating the latter between open and closed positions. As best shown in FIGS. 9 and 10, each ball is rotatable about a horizontal axis, being supported on elongate parallel follower arms 148, on opposite sides of the ball, extending upwardly from a support sleeve 149 resting on a follower sleeve 108, 108*a* and having lugs 150 slidable in vertical slots 151 in the cage. The arms terminate in end portions 152 formed on a small radius struck from a center corresponding substantially with the axis of rotation of the ball.

On each of its opposite sides, the ball has a flat surface 153 in which the notch 147 is formed, such surface also having a recess or notch 154 terminating at an inner curved wall portion 155 formed on a radius substantially corresponding to the arm end portion 152 and engaging the latter, whereby the ball is supported on a complemental arched surface 152 at each side of the ball for rotation between the open and closed positions in response to longitudinal or translational movement of the ball. In FIG. 10, the ball valve member is shown fully closed and sealed by the piston 96. In FIG. 9, the ball valve member has been rotated to the fully open position as a result of its being downwardly translated or shifted away from the resilient seal 101.

More particularly, the notch 154 on at least one side of the ball valve member is bounded by walls disposed in right angularly spaced locations, which form a first stop surface 156 and a second stop surface 157 cooperable with companion stop surfaces 158, 159 provided on the longitudinal parallel sides of an arm 148. To limit the rotation of the ball 97, 97*a* between the closed and open extreme positions illustrated in FIGS. 9 and 10, the stop surface 157 engages the stop surface 159, as shown in FIG. 10, thereby limiting rotation of the valve member to the position at which the valve is closed. The stop surface 156 engages stop surface 158, as shown in FIG. 9, to limit rotation of the valve member to the position at which the valve is opened.

Rotation of the ball valve between the open and closed positions is caused by its longitudinal or bodily translation relative to the cage 144 to which the pins 146 are affixed. As stated above, the ball is shifted or translated longitudinally by the annular piston 92, 92*a* and by the lower follower sleeve 108, 108*a*. The slot 147 into which each pin 146 projects is formed in such manner as to cause such rotation of the valve ball as the latter moves longitudinally within the cage 144 and the body 98, 98*a*. Thus, each slot is formed in the valve member by opposed walls 160, 161 which are disposed at a right angle to each other, and which, respectively, are parallel to the stop surfaces 156, 157 that coact with the follower arms 148. At the apex of the angle defined between the walls 160, 161, the slot opens radially inwardly to provide an inner portion 162. The relationship between each pin 146 and the walls 160, 161, is such that the ball valve will be rotated from the position of FIG. 10 to the position of FIG. 9 when the valve member moves downwardly relative to the pin by the piston 95, 95*a*. Conversely, the flat wall 160 will engage the pin 146 and rotate the ball valve member from the position of FIG. 9 to the position of FIG. 10 upon upward longitudinal movement of the valve member.

A further description of the relationship between the ball valve member and the follower arms and pins is unnecessary to an understanding of the present invention, being illustrated, described and claimed in U.S. Pat. No. 3,827,494, granted Aug. 6, 1974, of Talmadge L. Crowe, for "Anti-Friction Ball Valve Operating Means."

Both the upper and lower pistons 95, 95*a* that actuate the ball valves 97, 97*a* by the control pressure exerted through the control line 64, are pressure balanced with respect to the hydrostatic head of fluid in the annulus 39 between the upper tubular string 16 and the marine riser B. The landing head 58 has an external elongate circumferential groove 164 formed therein, across which a diaphragm sleeve 165 of elastomer material is disposed, this sleeve having upper and lower flanges 167, 168. A diaphragm protector sleeve 169 is disposed around the diaphragm, its upper end bearing against the upper flange 167 to secure it against a downwardly facing shoulder 170 of the landing head; whereas, the lower end of the protector sleeve bears against the lower flange 168, forcing it against an annular disc 171. A diaphragm retainer 27 is threaded on the landing head 158 and bears against the annular disc 171 to effect a clamping of the upper flange 167 between the protector 169 and landing head shoulder 170, and the lower flange 168 between the protector 169 and the disc 171. Assurance is had against loosening of the diaphragm retainer 27 by threading a set screw 173 therein that extends within a longitudinal slot 174 in the landing head.

A longitudinally extending passage 175 is provided in the landing head 58 that establishes communication between the annulus 176 behind the diaphragm 165 and an annular space 177 between a housing 178 surrounding the lower end of the landing head 58, the upper piston housing 93, the upper ball housing 98, and the lower piston housing 107. A side port 179 in the upper piston housing extends from the annular space 177 to the annular space R1 in the upper piston housing below the piston head 94. A similar port 180 provides communication between the annular space 177 within the outer housing 178 and the annular space or area R1 below the head 94*a* of the lower piston.

The annular space behind the diaphragm 165, the passage 175 through the landing head, and the annular space 177 between the outer housing and the several housings therewithin, as well as the ports 179, 180 and the annular spaces R1 below the upper piston head 94 and the lower piston head 94*a* are all filled with a liquid which may be introduced from the exterior of the landing head through an inwardly opening check valve 181 (of any suitable type) disposed in the landing head 58 that opens into the passage 175. The check valve permits entry of fluid into the several pressure balancing regions, but prevents reverse flow therethrough. Filling of the several regions just referred to is facilitated, and the entrapment of air prevented, by a lower port 182 in the outer housing 178 closed by threaded pipe plug 183 after the filling action has been completed.

As the apparatus is lowered through the fluid in the marine riser B and into its position within the blowout preventer stack E, the hydrostatic head of fluid externally of the apparatus exerts its force through the diaphragm 165 on the liquid in the several pressure balancing regions. This pressure is transmitted in an upward direction over the area R1 of the upper piston 92 and over the same area R1 of the lower piston 92*a*. The hydrostatic head of fluid in the control line 64 is being exerted over the full area of each upper piston head 94, 94*a* and also over the annular area R of the intermediate portion of each piston. This last-mentioned area is substantially equal to the area S across the piston head minus the annular area R1 against which the balancing liquid under pressure is acting. Accordingly, each piston is substantially pressure balanced with respect to the hydrostatic fluid acting on it. When the pressure is exerted through the control line 64, such pressure will act effectively over the outer annular area R1 of each piston head, exerting its downward force on both the upper and lower pistons to effect shifting of the ball valves to open condition. The pressure required is not varied because of the depth at which the production test valve assembly A is installed in the blowout preventer stack E. The same control fluid pressure is present in the piston chamber 62 beneath the latch locking piston 50 of latch means 15, so that the latch cannot be released while the control fluid pressure maintains the test valves 97, 97*a* open. As will be later described, moreover, such control fluid pressure also holds the tubing shutoff valve means T in an open condition.

THE INJECTION VALVE

Referring to FIGS. 3*i* and 3*j*, the injection valve assembly I is illustrated in greater detail. This valve assembly I is located in the tubular assembly just above the releasable latch unit 15 and comprises a body structure 200 connected in the tubular string between a lower connector sub 201 and an upper connector sub 202. The lower connector sub is threadedly connected to the upper end of the upper body sub of the latch mechanism 15 at 203 and the upper connector sub 202 is threadedly connected at 204 to a lower connector sub 205 of the tubing valve assembly T, which will be hereinafter described. The injection valve body structure 200 has a lower and outer body section 206 having an upstanding cylindrical section 207 internally threadedly connected at 208 to an inner and upper body section 209 which is in turn threaded at 210 to the lower end of the upper connector sub 202. In addition, the body structure 200 includes an upper and outer body section or sleeve 211 which is disposed about the lower body section 206 and internally threadedly connected at 212 to the upper and inner body section 209. A pair of axially spaced side ring seals 213 and 214 are disposed between the upper and inner body section 209 and the respective outer body sections 206 and 211, and additional side ring seals 215 and 216 are provided between the respective outer body parts whereby to form within the body a sealed internal chamber 217, to which suitable treating fluid such as glycol, methanol or other inhibitor, can be admitted through an upper body port 218 via a supply line or tubing 219, the tubing 219 extending to the drilling platform and being adapted to be supplied with the treating fluid from a suitable source, as will be later described. Within the body section 206 is one or more longitudinally extended passageways 220 which communicate with the internal chamber 217 and with a lower valve chamber 221. Check valves 222 are in each passage 220. One or more check valves 223 are in chamber 221, arranged in series with check valves 222 and adapted to permit the flow of the treating fluid from the chamber 217, through the passage 220 and into the valve chamber 221, such fluid passing through the lower check valve 223 into a small annular clearance space 224 defined between the lower body section 206 and a skirt 225 which depends from the inner, upper body section 209, the space 224 opening downwardly into the tubular assembly, so that the treating fluid can pass into the interior of the assembly, but the flow of production fluid upwardly through the tubular assembly cannot find access to the check valve outlet. Thus, the assembly I provides a means for injecting glycol or other treating fluid into the production string. Glycol, for example, is often injected into the production string in gas wells to inhibit formation of hydrates, and the injection valve structure I provides a means of providing the simple spring loaded check valves in series for preventing reverse flow in the event of internal production fluid pressure in excess of the pressure of the treating fluid in the supply tubing.

THE TUBING SHUTOFF VALVE

The tubing shutoff valve means T is illustrated in greater detail in FIGS. 3*d* through 3*h* and is claimed in my companion application which is also a division of application Ser. No. 843,154. This tubing shutoff valve means comprises a normally open valve adapted to be closed to contain any high pressure fluid or gas in the test string above the tubing shutoff valve after disconnecting the latch means 15, while dumping to the riser pipe the pressure from the short section of the tubular structure between the tubing shutoff valve and the previously described test valve body. As will be later described, the stinger 21 of the test valve latch assembly cannot be disconnected from the latch means until after the high tubing pressure has been beld off from the tubular assembly between the shutoff valves of the test valve assembly and the shutoff valve of the tubing shutoff valve.

More particularly, the tubing valve assembly T includes an elongated tubular body structure 300 connected at its lower end by a threaded connection 301 with the lower connector sub 205, previously described, and connected at its upper end by a threaded connection 302 to the lower tubular end 303 of the quick dump valve and quick disconnect valve pilot valve assembly P previously referred to.

The tubular body 300 of the tubing shutoff valve means T includes a lower body section 304 which provides pressure equalizing means 305 to be later described. At its upper end, the body section 304 is threadedly connected at 306 to an upwardly extended tubing dump valve housing 307, containing one or more laterally opening ports 308 between the interior of the housing 307 and the riser. To the upper end of the dump valve housing 307 is connected at 309 the lower end of a tubular cylinder 310, which at its upper end is threadedly connected at 311 within the lower end of a further upwardly extending tubular body 312, which is a cylinder sleeve for the actuator means 313 of the tubing shutoff valve means T, disposed within a further upwardly extending tubular body section 314, connected at 315 to the actuator cylinder 312 and connected at its upper end at 316 to the upper connector sub 317 whereby the tubular body assembly 300 is connected within the tubular string.

As seen in FIGS. 3*g* and 3*h*, the lower tubing valve body section 304 has a reduced external diameter section 320 providing axially spaced circumferentially extended shoulders 321 and 322, against which a circumferentially extended resilient bladder or diaphragm 323 is sealingly engaged and held in place by an outer retainer sleeve 324. The retainer sleeve 324 is secured to the body section 304 by a retainer nut 325 threaded at 326 onto the lower end of the body section 304 and suitably locked in place, whereby the upper and lower edges of the diaphragm or bladder 323 are clamped between internal flanges 327 and 328 at the top and bottom of the sleeve 324 against a downwardly facing shoulder 329 on the body and against the retainer nut 325. The retainer sleeve 324 has a suitable number of ports 330 opening into the annular space outside of the body assembly, whereby the bladder or diaphragm 323 is exposed to the pressure within the riser pipe.

Above the connection 306 between the body sections 304 and 307, these body sections define therebetween an annular space 331 containing an annular floating piston 332 having an internal side ring seal 333 engaging the cylindrical outer surface of the body 304 and an external side ring seal 334 engaging the internal cylindrical surface provided by the body section 307. One or more longitudinally extended passages 332*a* extend between the annular space 331 and the space within the bladder 323, whereby the chamber 331 and the space within the bladder can be filled with a clean fluid, such as oil, and the pressure of such oil acting on the lower end of the annular piston 332 will be the same as the pressure externally in the riser pipe. A fill port 331*a* is provided in the housing below the piston 332 and is closed by a plug 331*b*.

Above the floating piston 332, the tubing valve body section 307 has one or more radially opening ports 308, as previously described, also opening into the riser pipe, and these ports 308 are normally closed by first and second valve means. The first valve means is shown as sleeve valve means 335 comprising an elongated tubular valve sleeve or mandrel 336 slidably and sealingly engaged within the tubing valve body sections 307 and 310. Adjacent the lower end thereof the valve sleeve 336 has a pair of external side ring seals 337 and 338 sealingly engaged within the internal cylindrical surface of the body section 307 and bridging the ports 308 in the body section. The second valve means comprises a face sealing means 339 in the embodiment herein shown, including a face seal mandrel 340 of tubular form having at its lower end a cylindrical pilot 341 adapted to extend into the annular space between an external seal protector 342 of annular form threadedly connected at 343 to the valve body section 304, and an inner cylindrical extension 344 of the body section 304. An elastomeric face sealing ring 345 is provided between the cylindrical extension 344 and the seal protector 342 and is engageable by the pilot end 341 of the face seal mandrel 340, to prevent the passage of well production fluid between the valve body section 304 and the face seal mandrel 340, when the face or second sealing means is closed. However, when the first and second valve means just described are open, it will be recognized that communication is established between the interior of the tubing valve body and the annular space within the riser pipe, so that when the subsurface test valves are closed and the tubing valve means T are closed, the high pressure gas or fluid within the tubular string between the subsurface test valve assembly and the tubing valve assembly can be discharged to the annulus in the riser pipe.

As will be later described, the first and second valve means 335 and 339 operate in sequence. In addition, means are provided in the form of a collet or latch 346 for initially preventing opening of the first valve means 335, until the tubing valve means T has been closed. This collet latch means 346 includes a plurality of circumferentially spaced elongated resilient fingers 347 having outwardly projecting end lugs 348 engageable beneath a downwardly facing shoulder 349 provided within the tubular body section 310, the fingers having a ring member 350 threadedly connected to the sleeve valve mandrel 336 as at 351, so as to normally enable the latch fingers 347 to prevent upward movement of the sleeve valve mandrel.

Externally of the sleeve valve mandrel 336 is an annular shoulder or piston 352 having a side ring seal 353 engageable within the enlarged cylindrical bore 354 provided within the valve body section 310. Extending upwardly from the piston 352 is a cylindrical extension 355 of sleeve valve mandrel 336 having a side ring seal 355*a* slidably and sealingly engaged with a reduced diameter cylindrical wall 355*b* of the valve body section 310. Above the sleeve valve mandrel extension 355, is an annular space 356, below an internal annular flange or piston 357 on the valve body section 310, which has an internal side ring seal 358 slidably engaging the external cylindrical surface 359 of the face seal mandrel 340. This face seal mandrel 340 extends upwardly through the annular flange or piston 357 and has an upward cylindrical extension 360 slidably and sealingly engaged within an upper end sealing section 361 of the valve body section 310 having a side ring seal 362 sealingly engaged with the external cylindrical surface 363 of the face seal mandrel extension 360. At its upper end the face seal mandrel 340 has an end section or piston 364 provided with an external side ring seal 365 slidably and sealingly engaged within an internal cylindrical bore 366 provided within the spring housing or valve body section 312, as well as an internal side ring seal 367 which slidably and sealingly engages the external cylindrical surface 368 of a balance sleeve 369 for the tubing valve actuator means, as will be later described.

At the lower end of the sleeve valve mandrel 336 is a downwardly extended skirt 370 slidably engaging the lower valve body section 304 and the seal protector 342 and defining with the interior of the valve body section 307 and annular space 371. This annular space communicates through a suitable number of ports 372 in the skirt 370 with an annular space 373 which extends longitudinally between the sleeve valve mandrel 336 and the face seal valve mandrel 340, upwardly above the upper end of the sleeve valve mandrel 336, to the annular space 356. In the annular space 356, the annular space 373 and the annular space 371 is a quantity of clean fluid, such as oil, under the pressure of fluid in the annular space in the riser pipe. The clean fluid or oil is admitted to these spaces by means of axially spaced radial ports 371*a*, above piston 332, and 356*a* below the head or cylinder flange 357. Pressure is transmitted to such clean fluid through the previously described diaphragm or bladder 323 and the annular floating piston 332.

The actuator means 313 for the tubing shutoff valve T, as best seen in FIGS. 3*d* and 3*e* comprises an elongated tubular piston sleeve 400 extending longitudinally within the actuator body or spring housing 312 and defining therewith an annular chamber 401 in which a coiled compression type spring 402 is disposed. The spring 402 seats at its lower end on the upper end 364 of the face seal mandrel 340, and at its upper end the spring 402 engages an outwardly extended flange or spring seat 403 formed on the piston sleeve 400. Thus, the spring 402 normally biases the piston sleeve 400 upwardly with respect to the spring housing 312. At its lower end, the piston sleeve 400 has a reduced diameter section 404 slidably disposed within the upper end 405 of the previously referred to balance sleeve 369, which carries an internal side ring seal 406 slidably and sealingly engaging the outer cylindrical surface 404 of the piston sleeve. The balance sleeve 369 includes a downwardly extended skirt 407 slidably disposed within the internal seal 367 carried by the upper end 364 of the face seal mandrel 340. As shown in broken lines in FIG. 3*e*, the balance sleeve may also be shifted upwardly with respect to the actuator piston sleeve 400 into engagement with a downwardly facing shoulder 409 thereon, in the event that pressure of production fluid flowing through the assembly acting upwardly on the balance sleeve exceeds the pressure of control fluid, as will be later described, acting downwardly on the balance sleeve on the annular area between the seals 367 and 406.

The actuator body or spring housing 312 also has an internal guide flange or cylinder head 410 having an internal side ring seal 411 slidably engaging the piston sleeve 400 above the spring seating flange 403. Below the guide flange 410 is an annular space 412 containing an annular piston 413 having an internal side ring seal 414 slidably engaging the external cylindrical surface of the piston sleeve 400 and an external side ring seal 415 slidably engaging within the cylindrical bore of the spring housing 312.

Thus, it will be seen that between the elongated piston sleeve 400 and the spring housing 312, and between the upper flange 410 engaging the piston sleeve 400 and the balance sleeve 369, there is defined a control pressure fluid chamber 416, to which control fluid is applicable through an elongated passage 417 in the spring housing 312 which is in communication with a control fluid supply conduit 418, the spring housing 312 having a radial port 419 establishing communication between the fluid passage 417 and the control fluid pressure chamber 416. The control fluid in the chamber 416 can act upwardly on the annular area A1 shown in FIG. 3*e*, which is the difference between the sealing diameter of the upper seal 411 between the spring housing and the piston sleeve and the lower seal 406 between the piston sleeve and the balance sleeve. At the lower end of the spring housing 312 the control fluid supply passage 417 is connected with the control fluid conduit 64 leading to the latch means 15 and the subsea valve means 14, previously described.

At this point it is notable that at the upper end of the face seal mandrel 340, it is provided with a number of drilled holes or passages 360' communicating at their upper ends with the control fluid pressure chamber 416 and opening at their lower end into the annular space or chamber 357' defined between the upper seal 362 and the lower seal 358 between the valve body section 310 and the face seal mandrel. Also, drilled holes or passages 356' extend longitudinally through the valve body section 310, traversing the upper piston flange 357 and establishing communication between the annular space 357' and the annular space 354 defined between the upper seal **355*a* and the lower seal 353, between the sleeve valve mandrel and the valve body 310**.

The valve body section or spring housing 312 also has another elongated fluid passage 420 extending longitudinally thereof and connected with a supply conduit 421 for disconnect fluid under pressure, the passage 420 also being connected to the downwardly extended conduit 38, so that such fluid pressure supplied as later described, can be transmitted on to the disconnect or latch releasing mechanism previously described. The disconnect fluid passage 420 communicates by one or more radial ports 422 in the body 312 with the annular space 412 between the floating piston 413 and the internal body flange or cylinder head 410. Disconnect fluid pressure will therefore exert a downward force on the floating piston in opposition to control fluid pressure acting upward. When disconnect pressure exceeds control pressure, the net force downward will be transmitted to the elongated piston sleeve 400 by the floating piston. In addition, the disconnect fluid passage 420 communicates through one or more radial ports 423 with the annular space 424 between the upper piston end 364 of the face seal mandrel 340 and the inner seal 362 between the body 310 and the exterior of the face seal mandrel upper end section 360. The valve body section 310 also has one or more elongated passages 425 extending between this chamber 424 and the space **352*a* below the piston flange 352 on the sleeve valve mandrel 336 and above the seal 337 between the mandrel 336 and the valve body section 307, containing the latch means 346, which initially hold the sleeve valve mandrel 336 in its lowermost position, where disconnect fluid pressure can act upwardly beneath the flange 352 which sealingly engages within the bore 354 of the body 310. Thus, it is apparent that control fluid pressure in the bore 354 acts downwardly on the piston flange 352, while disconnect fluid pressure acts upwardly on the flange 352. In addition, control fluid pressure acts downwardly on the flange or piston 364 of the face seal valve mandrel 340, as well as upwardly on the area of the face seal mandrel exposed to control fluid pressure in the chamber 357'**.

In the form illustrated the net areas on which the control fluid pressure acts downwardly on the face seal mandrel 340 and on which the disconnect fluid pressure acts upwardly thereon are the same. This relationship of areas can be understood by reference to the diameters D1, D2, D3, and D4 shown on FIG. 3*e* where:

Area exposed to disconnect pressure $= D1 - D2$

Area exposed to ball control fluid pressure $= (D1 - D3) + D3 - D4 - (D2 - D4) = D1 - D2$.

In addition it will be recognized that there is an additional differential area between the diameter D3 and the sealing point or diameter between the elastomeric seal 345 and the end 341 of the face seal mandrel, upon which the pressure of production fluid within the inside of the assembly can act downwardly to assist spring 402 to hold the face seal in a normally closed position. Control line pressure, the force of the spring 402 and tubing pressure hold the face seal closed, but that disconnect pressure tends to open it. When control line pressure is decreased and disconnect pressure is increased sufficiently, the face seal valve opens.

The pressure of clean oil or fluid between the face seal and sleeve valve mandrels, which is determined by the hydrostatic pressure of fluid in the riser pipe acts upon opposite, equal areas of the sleeve valve mandrel 336, as indicated by the fact that the vertically spaced seals 337 and 338 spanning the body ports 308, as well as the upper seal **355*a* carried by the sleeve valve mandrel all engage the body 307 and the body 310 on the same diameter. On the other hand the pressure of control fluid acting on the sleeve valve mandrel flange 352 is applicable to the same area as is the disconnect fluid pressure acting upon the flange 352 in the opposite direction, so that opening of the sleeve valve means by upward movement of the sleeve valve mandrel 336 will be in response to an increase in pressure of the disconnect fluid pressure acting upwardly on the sleeve valve mandrel after control fluid pressure has been bled off, but such disconnect pressure must first overcome the holding effect of the collet latch fingers 347**.

Referring to FIGS. 3*d* and 3*e*, as well as to FIGS. 11*a*, 11*b*, 12, it will be seen that the tubing shutoff valve means T includes a rotatable ball type valve 500 much like those previously described in the subsurface test valve assembly, in that the ball valve 500 has a fluid passage 501 therethrough adapted to establish communication through the tubular string when the ball valve is in the open position (FIG. 3*d*) with the passage 501 aligned with the flow passage through the string, but the ball valve is rotated 90° (FIG. 11*a*) to close off the flow of fluid through the passage of the tubular string. The ball valve member 500 is pivotally mounted on pins 502 projecting diametrically therefrom into pin receiving recesses in the upper ends 503 of the longitudinally extended ball carrier or control bars 504, these bars extending longitudinally in elongated slots 505 in an outer support sleeve or cage 506 which is disposed in the valve body section 314 between a downwardly facing shoulder 507 on the connector sub 317 and an upwardly facing shoulder on a ring 519 which has slots 519*b* through which the bars 504 slide. The ring 519 seats on a sleeve 520 which in turn, seats on a shoulder 508 provided at the upper end of the lower housing section 312. At their lower ends the control bars 504 are connected by lugs 509, which engage an annular upper end section 510, to a control connector member 511, which is threadedly connected at 512 with the upper end of the valve actuating piston sleeve 400. Slidably and sealingly engaged within the upper end of the control connector 511 is a valve seating and sealing sleeve 513 having an external side ring seal 514 engageable within the control connector and having an upper sealing end portion 515, preferably including an elastomeric seal providing a spherical seat for the spherical outer surface 516 of the ball valve 500. Carried at one or both sides of the ball valve by the cage or support member 506 is a pin 517 adapted to effect rotation of the ball valve with respect to the control arms 504 when the control arms are shifted longitudinally within the support or cage 506, by movement of the actuating piston sleeve 400. As previously noted, control fluid pressure acting over area A-1 aided by spring 402 holds the actuating piston sleeve up and the ball valve opens, whereas, disconnect fluid pressure acts downwardly over the total area of the floating piston 413 to move the actuating piston sleeve downward. When the actuating piston sleeve is moved downward, it causes the ball valve to close. In this connection, it will be understood, without requiring further specific detailed illustration or description, that the rotation of the ball valve 500 is effected in the same general manner illustrated and described with respect to FIGS. 9 and 10, wherein the ball valves of the subsurface shutoff valve assembly 14 are illustrated. However, it will be noted in the case of the ball valve 500, that when it is in the closed position, as seen in FIG. 11*a*, it must withstand the pressure of production gas or fluid thereabove, when, as will be hereinafter described, the latch means 15 are released to permit removal of the tubing valve assembly T from the latch mechanism. Under these circumstances the lower end shoulder 513*a* on the sealing sleeve 513 abuts with the upwardly facing shoulder 508 on the sleeve valve body section 312 and differental pressure loading across the closed valve is transferred to the body. In addition, when the ball valve 500 is in the closed position, an elastomeric external seal 518 carried by the support ring 519 engages at the exterior of the sealing sleeve 513 and the exterior of the spherical seating surface 516 of the ball valve.

SUBSURFACE PILOT VALVE AND ACCUMULATOR

As previously indicated, the subsurface test tree automatic shutoff valves, as well as the tubing shutoff valve, are held open by control fluid pressure supplied from a vessel or platform atop the water, and the tubing bleed valve means 335 and 339 are held closed by such control fluid pressure. Also the latch means are held against release by such control fluid pressure. In addition, the releasable connector or latch means which hold the stinger at the lower end of the tubing valve assembly in the latch means are operable by disconnect fluid pressure supplied from the vessel or platform atop the water, but normally, the pressure of latch releasing or disconnect fluid in the subsurface latch mechanism and tubing valve mechanism is at hydrostatic pressure corresponding to the hydrostatic of fluid in the riser pipe. Thus, the operation of the subsurface test valve apparatus and the latch mechanism is not affected by the depth at which the apparatus is landed in the casing hanger. However, the bleeding off of the control fluid pressure which maintains the shutoff valves open and the application of increased pressure to the disconnect fluid for operating the latch mechanism are functions which are delayed, in the case of the prior art structures, by the amount of time necessary for the pressure change to be effected at the subsurface location after initiation at the vessel or platform atop the water. As the water depths increase, then, obviously, the time delay for the response correspondingly increases, whereas, it is necessary or desirable that the responsiveness of the subsurface apparatus be very rapid, say within twenty (20) seconds or less, at a depth of five thousand (5,000) feet, during which period the subsea production test valves can be closed and the latch mechanism released. Further delay in the operation of prior systems is occassioned by the presence of high pressure gas in the tubing between the test valve and the surface, which must be bled off at the surface before disconnecting the tubing from the safety valve. The subject tubing shutoff valve and bleed off valve means enable the section of tubular structure between the subsurface test valves and the tubing shutoff valve to be very rapidly vented to the riser, without requiring that the high pressure gas be bled off at the surface or at the vessel or platform.

Figure 1A:
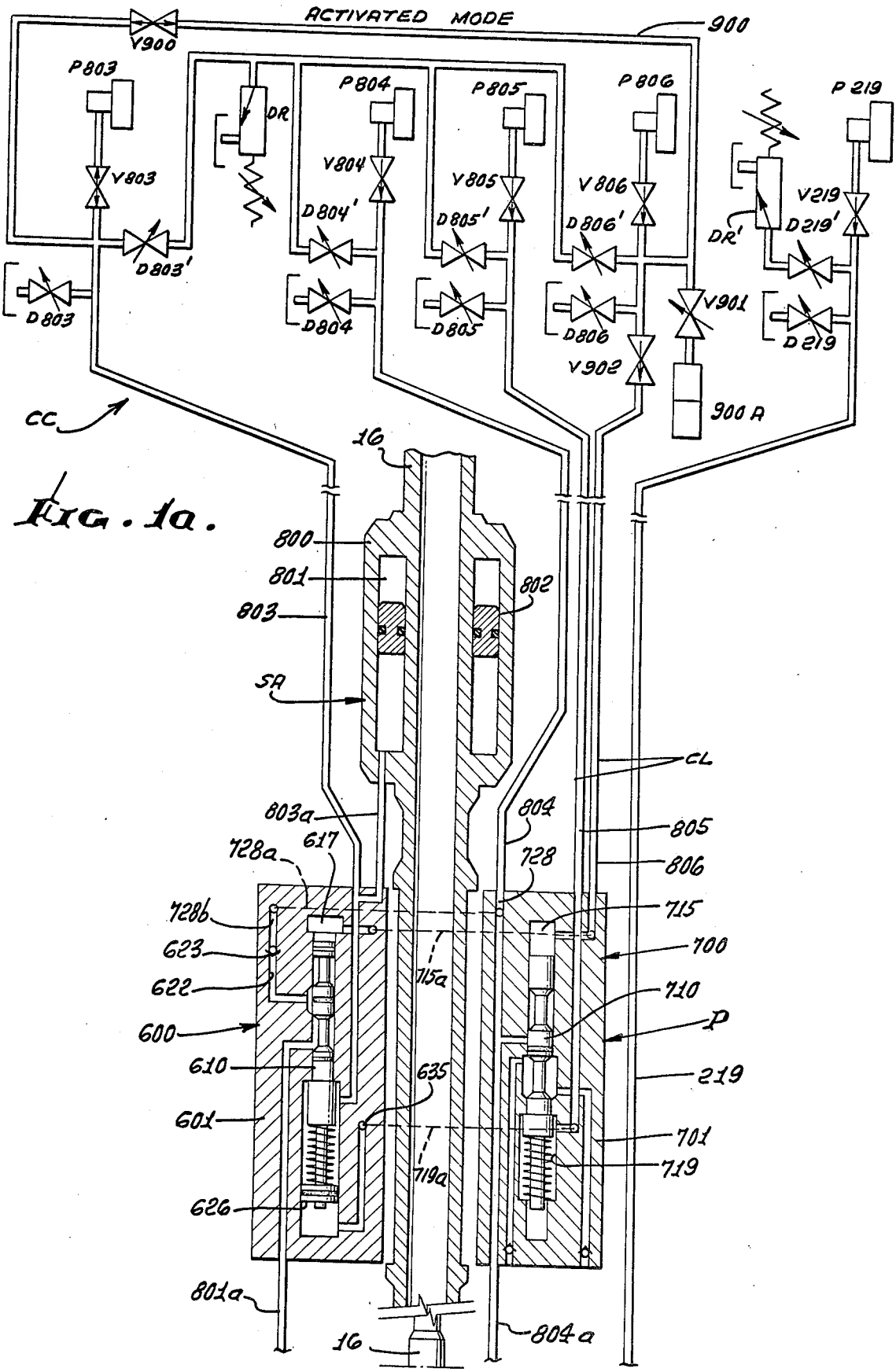
Figure 1B:
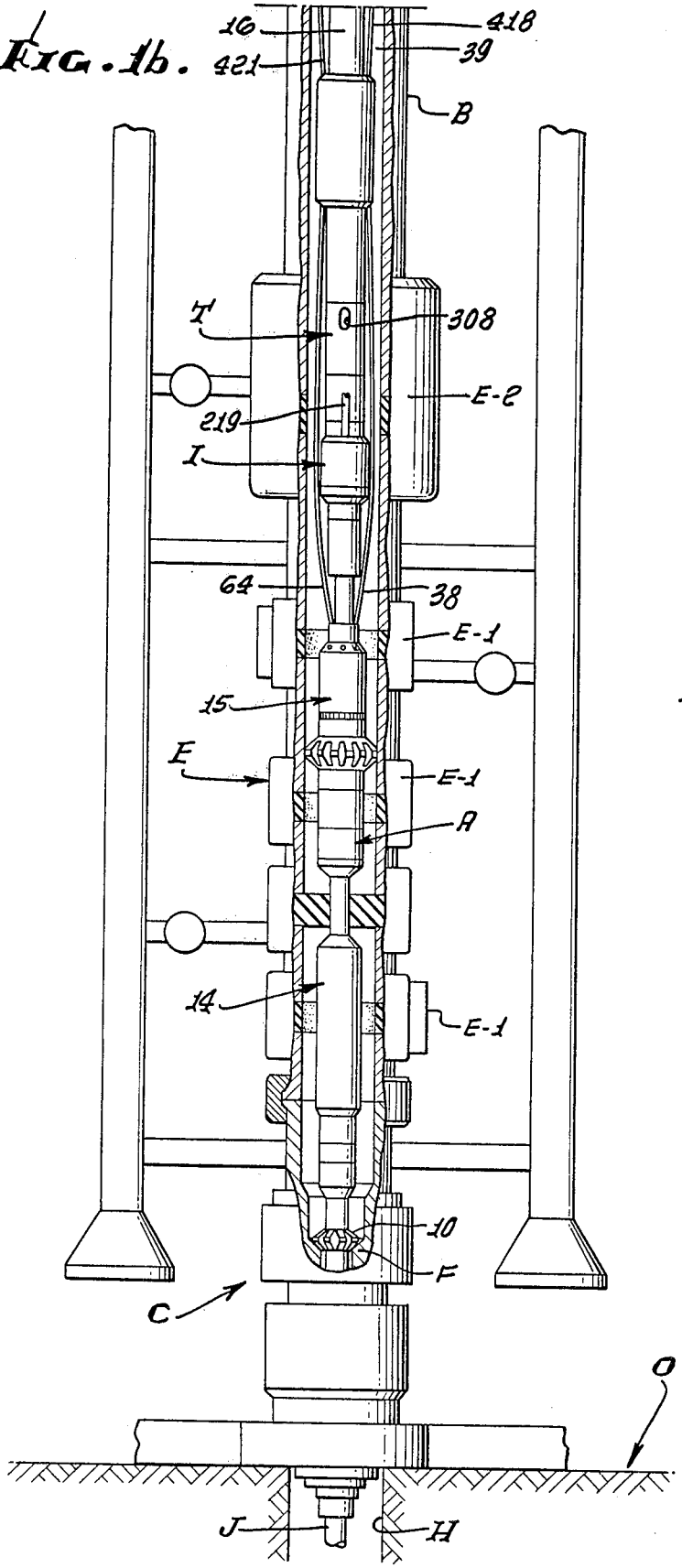
Figure 2:
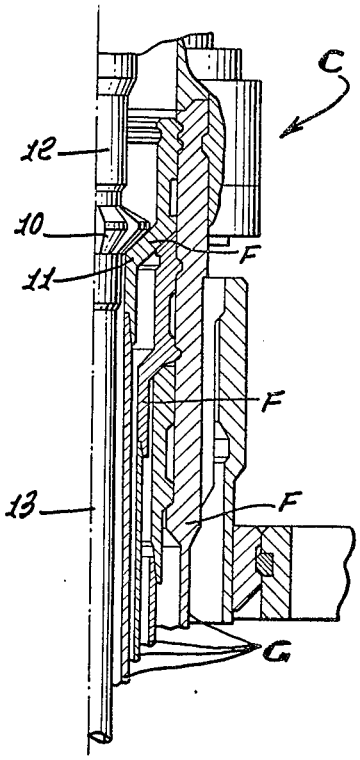

Accordingly, as schematically illustrated in FIGS. 1*a* and 1*b*, and as more specifically illustrated in FIGS. 6*a*, 6*b*, and 7*a*, 7*b* together with the related views, the present invention provides, in association with the tubular structure lowered into the well and landed on the casing hander C at the subsea floor, a combination of the previously referred to pilot valve means P and the subsurface accumulator A, whereby the capability of quickly bleeding off the control fluid pressure and quickly thereafter applying latch releasing fluid pressure, after venting of the tubular section between the tubing shutoff valve and the subsurface test valves to the riser, is provided in the subsurface apparatus. The operation of the pilot valve means P is under the control of the control console CC on the vessel or platform atop the water and pilot valve control pressures supplied through the operation of the control console can effect very rapid operation of the pilot valve means in response to relatively small pressure changes, as will be later described.

More particularly, the pilot valve means P includes disconnect pilot valve structure 600 and dump pilot valve structure 700, respectively shown diagrammatically in FIG. 1*a* and in more detail in FIGS. 6*a*, 6*b*, and 7*a*, 7*b* suitably carried by the upwardly extending pipe string 16. As illustrated, the valve assemblies 600 and 700 are in the form of semi-circular bodies 601 and 701 disposed about the pipe 16 and clamped together at a vertical meeting plane by suitably means such as by threading into threaded bores 602 in the valve body 601, cap screws 702 engaged with the body 701, the pipe 16 being provided with suitable stop shoulders 16*a* and 16*b* in vertically spaced relation for the reception of the body half parts 601 and 701 therebetween.

The subsurface accumulator SA is also carried by the pipe string 16 and supported thereon by suitable means not requiring illustration herein, and as seen in FIGS. 1*a*, 3*a*, 3*b*, and 4, the accumulator SA comprises a tubular body 800 having therein an annular chamber 801, in which is disposed an annular piston 802 longitudinally shiftable and sealingly engaged within the annular chamber 801. This chamber 801 is formed between the outer body 800 and an inner tubular section 800*a* threadedly connected at its upper end 800*b* to the upwardly extended tubing 16, and threadedly connected at its lower end 800*c* to a tubing connector 800*d*. An upper cylinder head 800*e* is threaded into the upper end of the outer body 800 and has a side seal 800*f* engaged therein and an internal side seal 800*g* is engaged between the head 800*e* and the inner body 800*a*. A lower cylinder head 800*h* is threaded into the lower end of the outer body 800 and has a side seal 800*i* engaged therein and an inner side seal 800*j* engaged between the lower head and the inner body 800*a*. These cylinder heads are captured on the inner body 800*a* between a downwardly facing upper shoulder 800*k* on the body and an upwardly facing shoulder 800*l* on the connector 800*d*. Nitrogen or other suitable pressurizing gas, can be supplied to the piston chamber 801, above the piston 802, through a fill port 801*a*. To enable this, the head 800*e* has a passage 801*c* leading between the chamber 801 and an upper bore 801*d* (FIG. 4) in the head 800*e*, through a shutoff valve port and seat member 801*e* sealed in the bottom of the bore by a ring seal 801*f*, retained in place by a stop ring 801*b*, and having a seat 801*g* engageable by the conical lower end of a needle valve 801*h*. The needle valve has a side seal 801*i* engageable in the bore 801*d* and is threaded into the head at 801*j* to hold it against seat 801*g* and to enable it to be backed off the seat by a tool applied to the tool socket 801*k* to establish communication between the fill port 801*a* and the passage 801*c*. When the accumulator has been pressurized, through the fill port 801*a*, the valve 801*h* can be closed. In the lower head, is a fluid passage 800*m* connected to a conduit 803*a*. Accumulator piston 802 has upper and lower side seal rings 802*a* and an intermediate side seal ring 802*b*, as well as porting 802*c*, whereby the rings 802*a* stabilize the piston and the ring 802*b* separates the gas from the disconnect fluid supplied to the accumulator as described below.

Extending downwardly from the control console CC is a fluid conduit or hose 803 which is connected to the disconnect valve assembly 600 and communicates through the branch conduit 803*a* with the accumulator chamber 801 below the piston 802, so that when, during use of the apparatus, the disconnect fluid line 803 is pressurized, as will be later described, the pressure of such fluid acting upwardly on the accumulator piston 802 will compress the air or gas in the chamber 801 above the piston, so that the source of pressurized disconnect fluid is essentially located at the subsea location closely adjacent to the disconnect pilot valve means 600. Also extending downwardly from the control console CC is a control fluid pressure conduit or hose 804 adapted to conduct control fluid pressure to the respective valve actuators in the subsurface test valve apparatus and in the tubing shutoff valve apparatus, as previously described, this control conduit 804 leading to the quick adump pilot valve means 700. In addition, extending downwardly from the control console CC to the quick dump pilot valve means 700 are a dump valve pilot pressure conduit 805 and a disconnect valve pilot pressure line 806.

Leading downwardly from the disconnect pilot valve means 600 is a disconnect fluid pressure conduit 801*a*, and leading downwardly from the dump pilot valve means 700 is a valve control fluid pressure conduit 804*a*. The disconnect pilot valve means includes a valve member 610 which in one position closes off communication between the supply conduit 803 and the downwardly extending conduit 801*a* (FIG. 1*a* and FIGS. 6*a*, 6*b*) and in the alternate position allows such communication. The dump pilot valve means 700 has a valve member 710 which in one position permits pressurization of the control fluid pressure conduit 804*a* from the control fluid supply line 804 (FIG. 1*a* and FIGS. 7*a*, 7*b*) and in the alternate position bleeds control pressure fluid to the riser pipe. The bleeding of control fluid pressure to the riser pipe, upon shifting of the pilot valve member 710 to its alternate position, permits the automatic closure of the subsurface test valves and releases the hydraulic lock on the locking piston 50 of the latch means. The shifting of the valve member 610 to its alternate position allows the disconnect fluid in the accumulator to be supplied to the tubing valve means T to close the valve therein and then sequentially vent the tubular structure between the closed subsurface test valve and the tubing valve to the riser and then release the latch mechanism.

Referring to FIGS. 6*a* and 6*b*, the quick disconnect pilot valve means 600 will be seen to include the valve member 610 in the form of an elongated spool 611 having three axially spaced lands 611*a*, 611*b*, and 611*c* thereon reciprocable in a longitudinally extended bore 612 and having suitable resilient side ring seals 613 thereon. At the upper end of the body 601 is an enlarged bore 614 closed by a threaded plug 615 having a seal 616 engaged within the bore to define a disconnect pilot pressure chamber 617 above the valve spool, with the land 611*a* on the spool constituting a piston exposed to the pressure of fluid in the chamber 617. A disconnect pilot fluid passage 618 opens into the chamber 617 and extends outwardly from the chamber for connection, as will be hereinafter described, with the disconnect pilot pressure line 806, through the pilot valve means 700. Adjacent the lower end of the valve bore 612 is a circumferentially extended enlarged groove 619 located above the land 611*c* when the valve member 610 is in the upper position, this groove 619 communicates with a valve passage 620 leading downwardly through the body and connected with the downwardly extended conduit 801*a*. Between the ends of the valve bore 612 is another enlarged circumferential groove 621 which, when the spool is in the upper position receives the intermediate land 611*b* thereon, whereby the bore 612 establishes communication between the above referred to passage 620 and another passage 622 which communicates with the groove 621 and extends upwardly in the valve body and contains a check valve 623 which is adapted to open upwardly. At the lower end of the valve bore 612 is an enlarged downwardly extended bore 624 in which is reciprocable the lower guide end 625 for the valve spool 611. Interposed between the lower end of the valve spool guide 625 and a valve locking piston 626 having a rod 627 is a coiled compression spring 628 which provides a spring bias biasing the locking piston 626 downwardly and the spool valve 611 upwardly. Under the conditions illustrated in FIGS. 6*a* and 6*b* the locking piston rod 627 is in an upper position disposed within a bore 629 opening downwardly in the valve spool guide 625. The disconnect fluid supply conduit 803 communicates with the bore 624 between the lower valve guide 625 and the locking piston 626 through a downwardly extended fluid passage 630 and a connecting lateral passage 631. The fit between the valve guide 625 and the housing in the bore 624 is such that disconnect fluid can fill the space between the valve guide 625 and the locking piston 626. In addition, the valve guide has a number of axial passages 632 which permit access of the disconnect fluid into the valve bore 612 below the lower land 611*c*, which separates the disconnect fluid supply passage 631 from the disconnect fluid passage 620, and the pressure of the disconnect fluid supplied through the supply conduit 803 is applicable to the valve land 611*c*, in opposition to the disconnect valve pilot pressure in the upper chamber 617 applicable to the valve land 611*a*. Otherwise the valve guide section 625 is balanced by virtue of the ports 632, and the upper end of the locking piston rod 627 is provided with a number of lateral ports 633 and an axial end passage 634, whereby the disconnect fluid finds access to the upper end of the guide bore 629.

By means later to be described, the dump valve pilot pressure conduit 805 is connected through the dump pilot valve 700 with a passage 635 in the valve body 601 which is connected with a lateral passage 636 leading to the valve bore 624 below the locking piston 626. Accordingly, dump valve pilot pressure supplied to the underside of the locking piston 626 can overcome the effect of disconnect fluid pressure and the spring 628 acting downwardly on the locking piston, whereby to maintain the locking piston 626 in the upper position and holding the valve spool 611 in the upper position. The pressure of dump pilot fluid below the locking piston 626 also overcomes a downwardly acting effect of the disconnect pilot fluid pressure in the upper chamber 617. However, when, as will be later described with respect to the quick dump pilot valve, the dump pilot pressure in the chamber below the locking piston 626 is vented to the riser pipe, the locking piston 626 will be urged downwardly, by the combined effect of the spring 628 and the pressure of disconnect fluid in the bore 624, to a lower position at which the valve guide 625 and the spool 611 are freed for subsequent downward movement as will be later described, when the pressure of disconnect pilot fluid in the upper chamber 617 can overcome the upward forces acting on the valve spool.

Referring to FIGS. 7*a* and 7*b*, the quick dump pilot valve means 700 is illustrated in greater detail. Here again, the pilot valve member 710 is in the form of an elongated spool 711 having an upper land or piston section 711*a*, an intermediate land or piston section 711*b*, and a lower land or piston section 711*c*. The upper piston section 711*a* is reciprocable within a cylindrical sealing section 712 of the valve bore, and when the valve member 710 is in its upper position, as shown, the intermediate piston section 711*b* is also disposed within the sealing bore 712. The lower piston section 711*c*, when the valve member is in the upper position, is disposed in a lower sealing section 712*a* of the valve bore. Suitable side ring seals 713 are provided between the respective sealing bores and the lands or piston sections of the valve spool. Between the sealing bores 712 and 712*a* is a circumferentially extended enlarged groove or chamber 714, closed at its opposite ends when the valve spool 711 is in the upper position by the piston sections 711*b* and 711*c* of the valve spool.

Above the valve spool 711 is an upper pressure chamber 715 formed in the valve body, closed by a threaded and sealed plug 716. This chamber 715 is a disconnect fluid pilot pressure chamber connected to the pilot conduit 806 by a lateral passage 717.

Below the land or piston section 711*c* of the valve spool is an enlarged guide head 718 slidably disposed in a downwardly extending enlarged bore 719 and having an elongated stem 720, the lower end of which extends downwardly into a lower closure plug 721 which is threaded and sealed into the lower end of the valve body 701. Disposed about the rod 720 is a coiled compression spring 722 seating at its lower end on the plug 721 and at its upper end beneath the guide section 718 of the valve member to normally apply an upward spring bias, tending to hold the valve spool 711 in an upper position with the guide 718 abutting beneath the downwardly facing shoulder 723 provided beneath the lower sealing bore 712*a*.

Communicating with the lower bore 719, below the sealing bore 712*a*, is a fluid passage 724 which extends upwardly and is connected with the dump valve pilot pressure line 805. Since the guide section 718 of the valve member loosely fits within the bore 719, dump valve pilot fluid finds access to the bore 719, filling the same when the valve is in the upper position, and acting across the cross sectional area thereof to provide an upward force in addition to the force of the spring 722. At its lower end the valve rod 720 has a transverse port 725 and a longitudinal passage 726 communicating with the port, enabling the admission of the dump valve pilot fluid into the bore 727 of the plug 21, to act upwardly on the full cross sectional area of the stem within the chamber 719. The valve body 701 has another passageway 728 extending longitudinally therethrough, and connected at its upper end to the control fluid supply line 804, the lower end of the passage 728, at the bottom of the valve body being connected to the downwardly extending control pressure fluid conduit 804*a*. A laterally extended passageway 729 leads from the control fluid passage 728 into the sealing bore 712, above the side ring seal 713 on the piston section 711*b* of the valve spool, so that when the valve spool is in the upper position, as illustrated, control fluid pressure in the passage 728 is separated from the dump valve pilot fluid in the lower bore 719 below the side ring seal 713 in sealing bore 712*a*.

Communicating with the valve chamber 714 by a lateral passage 730 is a control fluid pressure dump passage 731 extending downwardly through the body and exiting through the lower end thereof through a check valve 732 which closes upwardly. Another lateral passage 733 communicates with the valve chamber 714 and is connected with a downwardly extended exhaust passage 734 which exits from the housing through an upwardly closing check valve 735. Accordingly, it will be seen that when the pressure of the dump valve pilot fluid in the passage 724 and in the bore 719 beneath the valve spool is reduced to the extent that the pressure of disconnect valve pilot fluid in the chamber 715 acting downwardly on the upper piston end 711*a* can overcome the upward holding effect of the dump valve pilot pressure and the spring 722, the valve spool 711 will shift downwardly until the intermediate spool piston section 711*b* is moved into the chamber 714, and allows communication between the control fluid passage 728, via the valve chamber 714, with the control fluid exhaust passage 731. In addition, it is apparent that when the valve spool 711 shifts downwardly, to a location at which the lower piston section 711*c* thereof moves downwardly from the sealing bore 712*a*, that the dump pilot fluid passage 724 will communicate, via the valve chamber 714, with the dump valve pilot fluid exhaust passage 734.

As schematically illustrated by broken lines in FIG. 1*a*, it will be noted that fluid connections are made between the respective valve bodies at three locations. A connection is made at 728*a* between the control fluid passage 728 in the valve body 700 and a connecting passage 728*b* in the valve body 600 at the downstream side of the upwardly opening check valve 623 in the passage 622, so that under the circumstances illustrated in FIG. 1*a*, the pressure of control fluid supplied from the control console exceeds the pressure of disconnect fluid in the passage 622, thereby holding the check valve 623 closed. Further, a connecting passage 715*a* bridges the bodies of the respective pilot valve assemblies between the disconnect pilot fluid chamber 715 in the body 710 and the disconnect pilot chamber 617 in the valve body 601. A further connecting passage 719*a* extends between the bore 719 below the valve member 17 of the pilot valve means 700 and the passage 635 in the body of the valve means 600 which leads to the chamber beneath the locking piston 626 of the latter. These connecting passages 728*a* and 715*a* are better illustrated in FIG. 5, wherein it will be seen that at the interface of the respective pilot valve bodies 601 and 701, sealing sleeves 715*b* and 728*b* are disposed in companion aligned bores in the respective body parts and bridge the bodies to prevent loss of fluid.

CONTROL CONSOLE AND OPERATION

Referring to FIG. 1*a*, a simplified or schematic control console is illustrated as including respective pressure sources P803, P804, P805, P806, and P219 for supplying fluid under pressure to the respective disconnect pressure conduit 803 valve control fluid conduit 804, dump valve pilot conduit 805, disconnect pilot valve conduit 806, and injection valve conduit 219. Each of the conduits 803 through 806 has a valve respectively designated V803, V804, V805, and V806. Likewise the conduit 219 has a valve V219 therein. These valves V803 through V806 and V219 are adapted to be in the open position as diagrammatically illustrated in FIG. 1*a*, when the subsurface apparatus is in the activated condition, with the subsurface test valves and the tubing valve open and with the latch mechanism locking the tubing valve to the subsurface test valve assembly. Each of these conduits also has its respective dump valve D803, D804, D805, D806, and D219, which in the mode shown in FIG. 1*a* are all diagrammatically illustrated as closed, but which when it is desired to effect emergency closure of the subsea test valve or to effect closure of the subsea test valve, closure of the tubing valve and release of the latch mechanism, or when the apparatus is being lowered into the casing hanger through the riser pipe can be selectively operated or shifted to an open position to enable bleeding of selected conduits or filling of selected conduits as may be required, and as will be described hereinbelow.

In addition, each of the conduits 803 through 806 has an additional valve respectively designated D803', D804', D805', D806', constituting dump valves connected to a common discharge pressure regulator DR, whereby all of the conduits can be bled down to a pressure equal to or somewhat above the difference in hydrostatic pressure of the riser pipe near the ocean floor and that of the normally lighter fluid in the various conduits. Such controlled bleeding enables the performance of various normal test functions without the danger of the conduits being collapsed and thereby damaged by hydrostatic pressure in the riser pipe. It will be noted that the conduit 219 has a dump valve D219' connected to a discharge regulator DR' to enable it to be independently reduced to a pressure equal to the difference in riser pipe hydrostatic pressure near the ocean floor and its internal hydrostatic pressure at the depth of the injection valve at which time the check valves 223 and 222 in the injection valve unit I will prevent flow from the subsea structure into the conduit 219.

To prevent an inadvertent disconnection of the subsea latch means, the disconnect fluid conduit 803 and the disconnect pilot line 806 are interconnected by a conduit 900 containing a valve V900 which remains open during running, activation, and closure of the subsurface valves. When it is desired to disconnect the tubing shutoff valve from the subsea test valves, the valve V900 would be closed. Connected with this conduit 900 is an accumulator 900A having a valve V901, and an additional valve V902 is provided in the disconnect pilot pressure conduit 806, which can be closed along with the valve V900 when the valve V901 is opened during charging of the system to allow the pressure source P806 to charge the accumulator 900A. Thereafter, the valve V901 can be closed and the valves V901 and V902 reopened, so that the stored fluid in the accumulator 900A is available for the purposes of initiating an emergency disconnect of the subsea latch means, if such disconnection becomes necessary or desirable.

It will be understood, without requiring detailed illustration, that the various console valves and pressure sources just described can be suitably remotely controlled as by a pneumatic or electrical operating system.

When the apparatus is being run into the riser pipe, the accumulator 900A is charged with high pressure fluid and all of the conduits are full of fluid. Pressure equal to the difference in hydrostatic pressure in the riser pipe near the ocean floor and the calculated hydrostatic pressure of a similar depth column of the fluid in the conduit is applied to the disconnect fluid conduit 803, disconnect pilot fluid conduit 806 and the injection conduit 219 and trapped there by closing valves V803, V806 and V219. Valve V900 is left open to insure that the pressures in conduits 803 and 806 remain equal.

To insure that the quick dump valve and quick disconnect valves will not be opened inadvertently, valve V805 is left open and normal operating pressure empirically determined to be a selected pressure, plus the difference in hydrostatic pressure in the riser pipe at the ocean floor, and the hydrostatic pressure of a similar depth column of fluid in the conduit is maintained in the dump valve pilot pressure conduit 805.

Ball control fluid valve V804 is left open and sufficient pressure is maintained on ball control fluid conduit 804 to insure that the subsea test valve and the tubing shutoff valve remains open while the apparatus is lowered into the riser pipe so that the tubing can fill with riser pipe fluid.

After the apparatus has been landed in the casing hanger, blowout preventer E-1 is closed in sealing engagement around the reduced center section of the subsea test tree thereby isolating the well bore from the riser pipe and anchoring the subsurface safety valve in the blowout preventer.

To ready the apparatus for testing the well, it is activated to the condition shown in FIGS. 1*a* and 1*b* by first increasing the pressure in the ball control fluid conduit 804 to a level such that this pressure acting over piston head 136 will overcome any tendency of well pressure either in the tubing or in the annulus below the blowout preventer to shift the tubing piston 135 upward. Due to the respective areas of the tubing pistons over which these pressures act, a pressure in the ball control fluid conduit of 60% of the anticipated well test pressure is usually sufficient. In addition, the pressure in the disconnect fluid conduit 803 and the subsurface accumulator 5A are now simultaneously increased to a level somewhat less, say 300 psi less, than the pressure previously trapped in the dump valve pilot pressure conduit 805.

Thus, when the pilot valve means P is in the condition shown in FIG. 1*a*, the dump valve pilot pressure in the quick disconnect valve means 600 below the locking piston 626 and in the quick dump valve means 700 in the chamber 719 is at a pressure in excess of the pressure of the disconnect pilot pressure in the respective upper chambers 617 and 715 of the quick disconnect pilot 600 and the quick dump valve means 700, above the respective valve members 610 and 710. It will also be noted that, since the valve V900 is open to establish communication between the disconnect pilot conduit 806 and the disconnect pressure conduit 803, the pressure of disconnect fluid in the quick disconnect pilot valve assembly 600 acting to release the lock piston 626 is less than the pressure tending to prevent such release of the lock piston, by the difference in the pressures initially applied to the dump valve pilot conduit 805 and the disconnect pilot valve conduit 806, so that no disconnection of the latch means can occur.

In the emergency mode of closing the subsea test valve, dump valves D804 and D805 of the respective ball control fluid conduit 804 and the quick dump valve pilot conduit 805 are opened to bleed these conduits to atmosphere, resulting in a rapid, but not necessarily large, pressure reduction in these two lines, resulting in the disconnect pilot pressure supplied to the upper chamber 715 of the quick dump pilot valve means 700 urging the dump pilot valve member 710 downwardly, so that the ball control pressure in the conduit 804*a* extending between the dump valve pilot means and the subsurface test valve and the residual pressure in the ball control fluid conduit 804 and the dump valve pilot conduit 805 adjacent to the quick dump pilot valve 700 also dumped or bled to the riser pipe. In addition, under these same circumstances, dumping of the quick dump valve pilot pressure from the chamber 719 to the riser releases the lock piston 626 in the quick disconnect valve means 600, but the pressure of fluid in the disconnect fluid supply line or conduit 803 and the spring beneath the valve member 610 maintain the valve member 610 in its upper position, overcoming the pressure of the disconnect pilot fluid in the upper chamber 617 of the quick disconnect pilot valve. At this time, the latch mechanism retaining the tubing shutoff valve in the subsurface test valve is still connected, but the latch mechanism has been conditioned for release by virtue of the dumping of the valve control fluid pressure to the riser, which has released the hydraulic lock on the latch lock piston 50 of the latch mechanism.

At this time if it is not necessary or desirable to release the latch mechanism, the system can be reactivated to relock the latch mechanism and reopen the subsea test valves.

However, if the tubing shutoff valve assembly is to be disconnected from the subsea test valve, this can be readily accomplished. The valve V900 is closed to separate the disconnect pilot pressure from the disconnect pressure supply conduit and the valve V901 is opened to allow high pressure fluid in the accumulator 900A to be supplied to the disconnect pilot fluid conduit 806, thereby forcing the quick disconnect pilot valve member 610 downwardly, enabling the disconnect fluid supply conduit 803 to be connected through the pilot valve means 600 to the downwardly extended disconnect conduit 801*a*, thereby applying disconnect pressure fluid to the tubing shutoff valve actuator piston 413 to force the piston sleeve 400 downwardly to cause the tubing shutoff valve ball to be rotated to the closed position, as seen in FIGS. 11*a* and 12. The pressure responsive area of the piston 413 is quite large, as compared with the area of the face valve mandrel piston 364 exposed to disconnect fluid pressure; the sleeve valve mandrel 336 is held in the closed position by the collet fingers 347, and the latch locking piston 50 is held against release by the shear pins 51*a*. Thus, the ball valve 500 is closed before the body ports 308 are opened to the riser and before the latch is released. Then the mandrel 336 of the sleeve dump valve is shifted upwardly to open the sleeve valve, followed by movement of the mandrel 340 of the face valve upwardly to open the face valve means, so that the pressure of fluid in the tubular structure in the interval between the tubing shutoff valve and the subsea test tree valves is dumped to the riser through body ports 308, any high pressure gas or fluid in the tubular structure above the tubing shutoff valve being effectively retained therein by the closed ball valve. Thereupon, the latch mechanism is released and the tubing valve structure, together with the pilot valve means and the subsurface accumulator can be raised to the drilling vessel or platform.

Closure of the subsea test valves and the tubing shutoff valve, as well as opening of the dump valves is effected in a very rapid manner, inasmuch as the subsurface pilot valve means and subsurface accumulator means can respond to very small changes in pilot pressure to dump the ball control fluid to the riser and apply disconnect fluid to the tubing valve and to the latch mechanism from a source closely located to the respective structures. Thus, it is not necessary to wait a long period of time for the usual control fluid pressure line to bleed down over a great length of conduit; nor is it necessary to pressurize a long length of disconnect fluid conduit. In addition, it is not necessary to wait any significant period of time for the bleeding off of high pressure gas or fluid in the tubular structure above the shut in subsea test valve structures.

These functions are accomplished by the novel combination of the tubing shutoff valve operable by disconnect fluid for the latch from the accumulator located at the subsea location and the pilot valve controlled dumping of valve control fluid pressure at the subsea location to close the test valve whether or not before closure of the tubing valve and release of the latch. Further, the provision of the tubing bleed valves, operable to bleed off high pressure between the closed test valve and tubing valve effects a time savings. It will be understood that such a tubing shut off, bleed and pilot valve control means can also be applied to other subsurface test valves.

I claim:

1. A fluid pressure operated valve assembly for sequentially diverting a first fluid flowing therethrough and allowing the flow of a second fluid therethrough; comprising: first valve means having passage means therethrough for a first pressurized fluid and a diverting opening, a first valve member shiftable between a first position closing said diverting opening and a second position establishing communication between said diverting opening and said passage means, means responsive to first and second operating fluid pressures for holding said first valve member in said first position thereof and moving said first valve member to said second position thereof; and second valve means having passage means therethrough for a second pressurized fluid, a second valve member shiftable between a first position closing said passage means for said second pressurized fluid and a second position opening the same, means responsive to said first and second operating fluid pressures for holding said second valve member in said first position thereof and moving said second valve member to said second position thereof, and means for conducting said first and second operating fluid pressures to said first and to said second valve means.

2. A fluid pressure operated valve assembly as defined in claim 1; said second valve member having means responsive to said second pressurized fluid for holding said second valve member in said first position thereof when said first operating fluid pressure is reduced until said second operating fluid pressure is increased.

3. A fluid pressure operated valve as defined in claim 1; including connecting passage means between said passage means of said first and second valve means downstream of said second valve member when said second valve member is in said first position thereof, said connecting passage having check valve means therein enabling flow from said passage means of said second valve means to said passage means of said first valve means when said second valve member is in said first position thereof.

4. A fluid pressure operated valve as defined in claim 1; including connecting passage means between said first and second valve means and a dump passage opening from said first valve means when said first valve member is moved to said second position thereof to enable movement of said second valve member to said second position thereof upon increase of pressure of said second operating fluid.

5. A fluid pressure operated valve as defined in claim 1; including connecting passage means between said first and second valve means and a dump passage opening from said first valve means when said first valve member is moved to said second position thereof to enable movement of said second valve member to said second position thereof upon increase of pressure of said second operating fluid, and also including connecting passage means between said passage means of said first and second valve means downstream of said second valve member when said second valve member is in said first position thereof, said connecting passage having check valve means therein enabling flow from said passage means of said second valve means to said passage means of said first valve means when said second valve member is in said first position thereof.

* * * * *